US007979921B2

(12) United States Patent
Cotutsca

(10) Patent No.: US 7,979,921 B2
(45) **Date of Patent: *Jul. 19, 2011**

(54) HOLDING SYSTEM FOR HEADWEAR

(75) Inventor: Peter Cotutsca, Tesuque, NM (US)

(73) Assignee: Broadmark, Inc., Los Angeles, CA (US)

( * ) Notice: Subject to any disclaimer, the term of this patent is extended or adjusted under 35 U.S.C. 154(b) by 1204 days.

This patent is subject to a terminal disclaimer.

(21) Appl. No.: 11/652,971

(22) Filed: Jan. 12, 2007

(65) Prior Publication Data

US 2007/0220656 A1 Sep. 27, 2007

Related U.S. Application Data

(63) Continuation-in-part of application No. 10/570,078, filed as application No. PCT/US2005/006981 on Mar. 2, 2005, now Pat. No. 7,275,270.

(60) Provisional application No. 60/549,636, filed on Mar. 2, 2004.

(51) Int. Cl.
*A42B 1/24* (2006.01)

(52) U.S. Cl. ..... 2/209.13

(58) Field of Classification Search ..... 2/209.13; 24/3.1; 351/155

See application file for complete search history.

(56) References Cited

U.S. PATENT DOCUMENTS 2,744,256 A 5/1956 Slotkin et al.
3,357,026 A * 12/1967 Wiegandt ..... 2/195.6
4,179,753 A * 12/1979 Aronberg et al. ..... 2/10
5,034,862 A 7/1991 Liston
5,053,932 A 10/1991 Case
5,253,368 A 10/1993 Blake
5,829,103 A 11/1998 Allen
5,860,167 A 1/1999 Lizio
5,867,874 A 2/1999 Simpson
5,894,604 A 4/1999 Crabb et al.
5,933,871 A 8/1999 Kraft (Continued)

FOREIGN PATENT DOCUMENTS

JP 3087717 4/1991

(Continued)

OTHER PUBLICATIONS

Broadmark, Inc., "International Preliminary Examination Report dated May 9, 2007," PCT Application No. PCT/US05/06981 filed Mar. 2, 2005.

(Continued)

*Primary Examiner* — Katherine Moran

(74) *Attorney, Agent, or Firm* — Blakely Sokoloff Taylor & Zafman LLP

(57) ABSTRACT

A utility holder assembly for securely holding articles such as eyewear and the like, small tools and accessories such as screwdrivers, flash lights, pliers, and the like, and writing utensils such as pencils, pens and the like to the sides of various types and styles of headwear. The utility holder assembly may be mounted on the outside surface or the inside surface of the headwear to accommodate easy insertion of an article for temporary storage. The holder may include a gripping mechanism such as hook and loop fasteners, a ductile layer, or a ductile member, such that the holder may be configured to conform to the shape of the article to more securely retain the article within the holder. The utility holder may also hold an article securely when the headwear is removed.

78 Claims, 21 Drawing Sheets

U.S. PATENT DOCUMENTS

| | | | | |
|---|---|---|---|---|
| 6,115,843 | A | 9/2000 | Travalgia | |
| 6,185,748 | B1 | 2/2001 | DeChambeau | |
| 6,210,003 | B1 | 4/2001 | Chan | |
| 6,237,159 | B1 | 5/2001 | Martin | |
| 6,247,177 | B1 | 6/2001 | Hayes | |
| 6,298,495 | B1 * | 10/2001 | Totani | 2/209.13 |
| 6,442,764 | B1 | 9/2002 | Badillo et al. | |
| 6,481,059 | B2 * | 11/2002 | Morris | 24/3.12 |
| 6,644,807 | B1 | 11/2003 | Hood | |
| 6,647,554 | B1 * | 11/2003 | Yan | 2/209.13 |
| 6,668,426 | B1 | 12/2003 | Morris | |
| 6,671,885 | B2 * | 1/2004 | Viggiano | 2/209.13 |
| 6,719,437 | B2 | 4/2004 | Lary et al. | |
| 6,792,619 | B1 | 9/2004 | Morris et al. | |
| 7,003,809 | B1 | 2/2006 | Gordon | |
| 2002/0023287 | A1 | 2/2002 | Badillo et al. | |
| 2002/0069488 | A1 | 6/2002 | Morris | |
| 2003/0024033 | A1 | 2/2003 | Viggiano | |

FOREIGN PATENT DOCUMENTS

| | | |
|---|---|---|
| JP | 11222708 | 8/1999 |
| WO | WO 02/46828 | 6/2002 |

OTHER PUBLICATIONS

Supplementary European Search Report for EP Application No. 05724511 dated Oct. 2, 2009 (3 pages).

* cited by examiner

A - A

A - A

B - B

B - B

HOLDING SYSTEM FOR HEADWEAR

CROSS-REFERENCE TO RELATED APPLICATIONS

This application is a continuation-in-part of co-pending U.S. patent application Ser. No. 10/570,078, filed Feb. 28, 2006 now U.S. Pat. No. 7,275,270, entitled "Utility Holder for Headwear," which is a nationalization of International Application No. PCT/US2005/006981, filed Mar. 2, 2005, entitled "Utility Holder for Headwear," which claims the benefit of priority of U.S. Provisional Patent Application No. 60/549,636 filed on Mar. 2, 2004, entitled "Utility Holder for Head Wear," which are all hereby incorporated by reference herein in their entireties, including but not limited to those portions that specifically appear hereinafter, the incorporation by reference being made with the following exception: In the event that any portion of the above-referenced applications are inconsistent with this application, this application supercedes said above-referenced provisional application.

STATEMENT REGARDING FEDERALLY SPONSORED RESEARCH OR DEVELOPMENT

Not Applicable.

BACKGROUND

1. The Field of the Invention

The present disclosure relates generally to headwear, and more particularly, but not necessarily entirely, to an apparatus for holding a variety of articles including eyewear, writing utensils and other small tools and accessories on a user's headwear.

2. Description of Related Art

It is common practice for individuals to wear sunglasses or other types of eyewear, particularly in the outdoors, to protect the individual's eyes against the harmful rays of the sun. It is also common practice for individuals to further utilize headwear, such as hats, caps, visors or headbands, for example, to provide further protection against the sun or to keep sweat out of the individual's face. It often becomes desirable to remove eyewear, such as sunglasses for example, when entering a darkened environment. Moreover, it is common practice to utilize articles such as pencils, flashlights or tools such that it often becomes beneficial to provide a holding device for holding the eyewear or articles when they are not in use.

Holding devices are known in the art for holding articles, such as glasses, on headwear. However, the known holding devices may be limited by cumbersome designs which may not be very practical, economic or even visually appealing. Other known holding devices may not allow the articles to be securely held to the headwear or may be difficult to operate. Although the prior holding devices have been useful for their intended purpose, the implementation and ease of operation of the devices remains inflexible, rigid and costly.

Accordingly, a need has existed to provide a more versatile and flexible mechanism to conveniently hold a wide variety of different types, shapes and sizes of articles including eyewear, writing utensils and other small tools, on various types and styles of headwear. Such a holding mechanism is disclosed in the present holding system for headwear described herein. The present disclosure provides an improvement over prior art devices due to lower manufacturing costs and simpler design implementation with improved safety features and attaching capabilities.

The prior art is thus characterized by several disadvantages that are addressed by the present disclosure. The present disclosure minimizes, and in some aspects eliminates, the above-mentioned failures, and other problems, by utilizing the methods and structural features described herein.

The features and advantages of the disclosure will be set forth in the description which follows, and in part will be apparent from the description, or may be learned by the practice of the disclosure without undue experimentation. The features and advantages of the disclosure may be realized and obtained by means of the instruments and combinations particularly pointed out in the appended claims.

SUMMARY

The present disclosure describes a uniquely superior and convenient storage mechanism for articles such as eyeglasses, sunglasses, safety glasses, prescription glasses and the like, writing utensils such as pens, pencils and the like, and small tools such as screw drivers, pliers, laser pointers, small flash lights and the like, on a great variety of headwear.

Accordingly, one illustrative embodiment of the present disclosure may include a pair of utility holders positioned on the left and the right sides of headwear to receive the above described articles in a sliding manner. The utility holder material may be comprised of textile and/or flexible and/or elastic materials to accommodate the various sizes and shapes of the above described articles in a secure manner. The utility holder assembly may be permanently or removably sewn, attached, adhered or otherwise mounted to the exterior and/or the interior surface of the headwear.

The holder may include a top lateral edge or support and a bottom lateral edge or support, and the holder may have an open ended front edge and rear edge such that the holder may be capable of slideably receiving an article. The utility holder may be shaped and dimensioned, for slideably receiving a rear most portion of an article so that the rear most portion of the article, depending on the depth dimension of the article, may or may not project outwardly beyond the rear edge and/or the front edge of the utility holder, and therefore at least a portion of the article may be held securely within the utility holder.

In addition, the utility holder may also be mounted on the inside surface of the headwear to achieve a more integrated and unobtrusive design. The utility holder may also be mounted on an elastic head band type assembly which can be placed interchangeably on conventional headwear and therefore accommodate many sizes and styles of headwear.

Various different types of gripping mechanisms may be utilized with the holder so as to more securely retain the articles within the holder. It will be appreciated that the gripping mechanisms provided within the scope of the present invention provide advantages not hitherto available.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
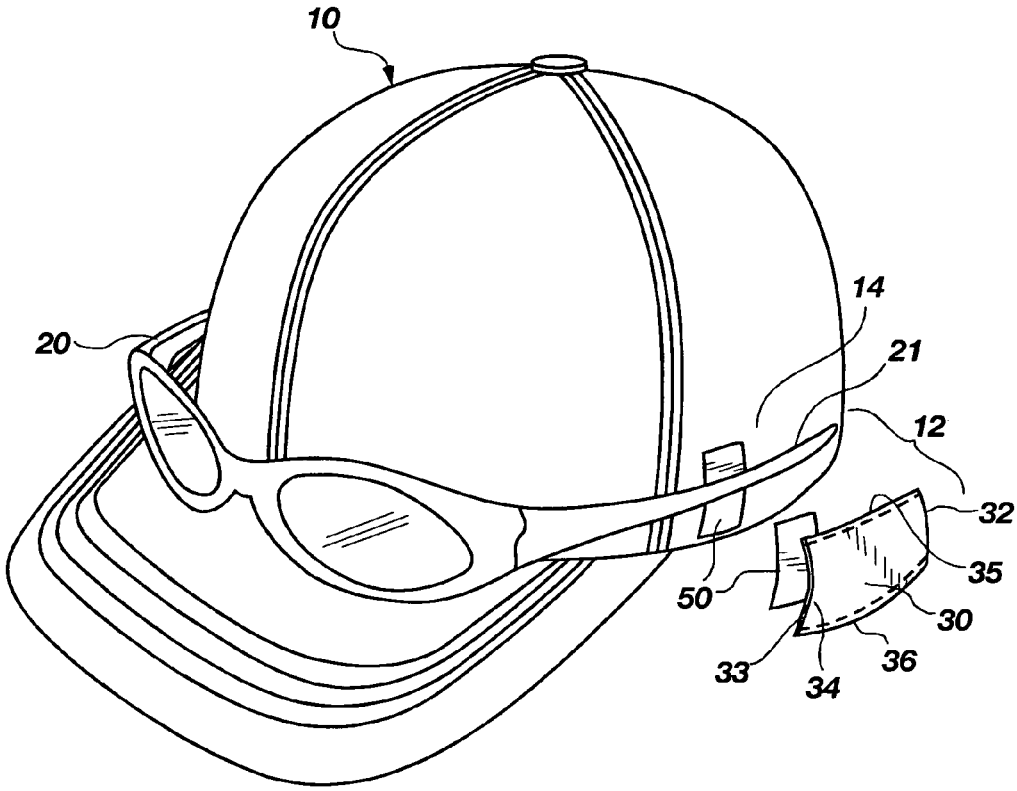
FIG. 1 is a perspective, three-dimensional exploded view of one embodiment of an externally mounted utility holder with an article inserted according to one embodiment of the disclosure.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

It must be noted that, as used in this specification and the appended claims, the singular forms “a,” “an,” and “the”

include plural referents unless the context clearly dictates otherwise. Moreover, as used herein, the terms "comprising," "including," "containing," "characterized by," and grammatical equivalents thereof are inclusive or open-ended terms that do not exclude additional, unrecited elements or method steps.

As referred to herein the term "ductile" shall be construed broadly to include a property in which an item has the capability of being molded or shaped by a human hand into different configurations by a typical user of the disclosed embodiments without the assistance of tools or machines, and wherein the item substantially maintains the molded shape unless acted upon by another molding force. Exemplary materials which can be utilized in accordance with the teachings of the present disclosure can be obtained from the publications, which are now incorporated herein by this reference: Callister, William D., *Materials Science and Engineering: An Introduction,* 4$^{th}$ Ed. (1997) (John Wiley & Sons, New York); and, Brady, George S., Clauser, Henry R. and Vaccari, John A., *Materials Handbook: An Encyclopedia for Managers, Technical Professionals, Purchasing and Production Managers, Technicians, and Supervisors,* 14th Ed. (1997) (McGraw-Hill, New York).

Referring now to FIG. 1, a perspective view of one illustrative embodiment of the present disclosure is shown, including a headwear member, indicated generally at 10. As used herein, the terms headwear, or headwear member, shall be construed broadly to include various articles of apparel known in the art that may be worn on a user's head, such as hats of various styles, including caps and visors, as well as head bands, for example. It is typical that the user will be human but it will be appreciated that it is also within the scope of the present disclosure to accommodate other anatomy and structures which fall within the scope of the term "head" but which are other than human.

Figure 3:
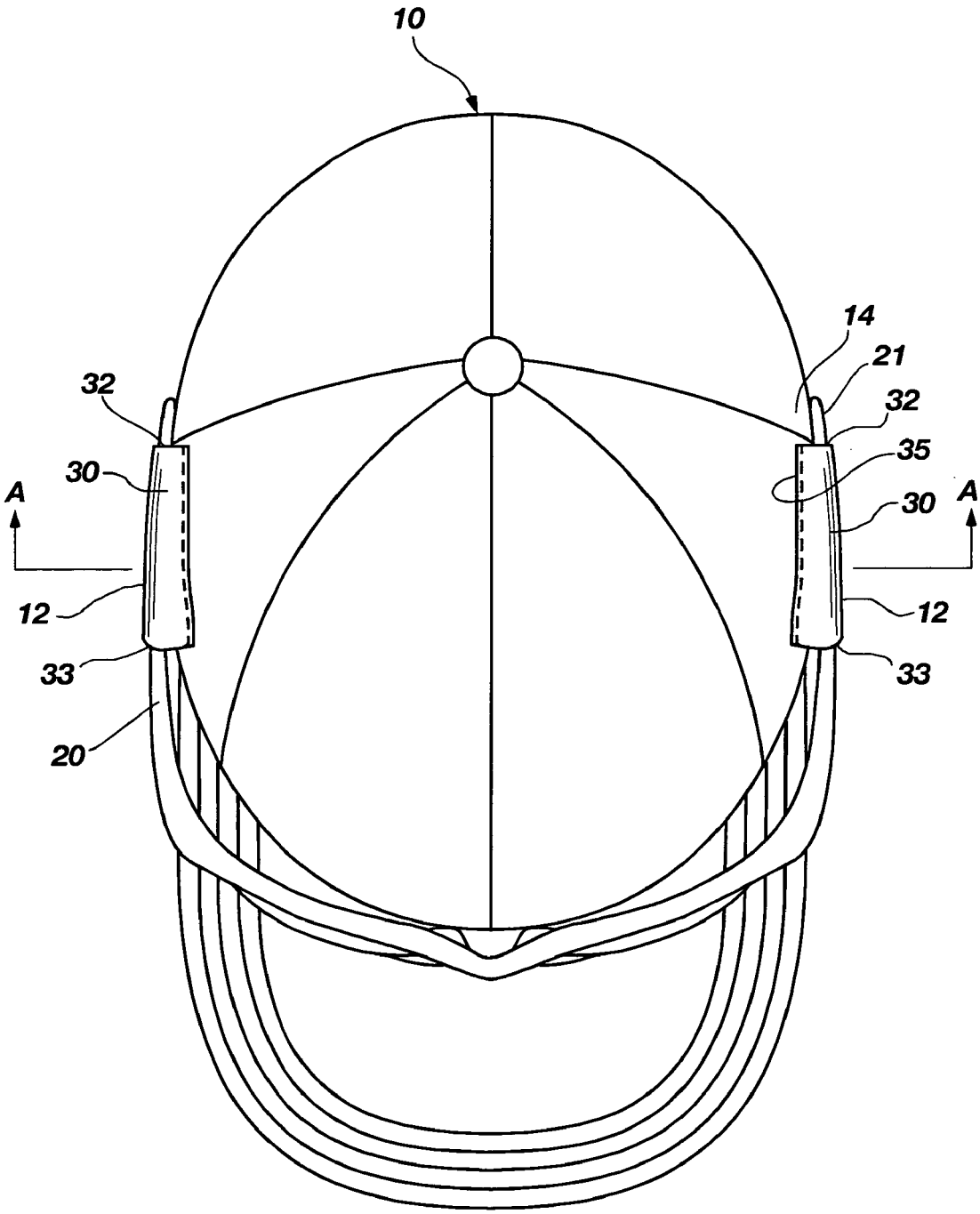
FIG. 3 is a top view of the embodiment of the disclosure of FIG. 1 or 2, depicting a storage position of an article in accordance with the principles of the present disclosure.

A holder, indicated by bracket 12 as shown in an exploded view in FIG. 1, may be disposed on one or more sides of the headwear member 10 for receiving an article 20, such as sunglasses. For example, a second holder 12 may be positioned on an opposite side of the headwear 10, as shown in FIG. 3, so that opposing temples of the sunglasses may each be received in a holder 12. The term article as used herein shall be construed broadly to include various different items that may be desirable for a user to hold on the headwear 10. For example, the article 20 may include items such as eyewear, including sunglasses, safety glasses or prescription glasses. The article 20 may also include items such as tools, including screw drivers, pliers, laser pointers, or flash lights, or any other item desired to be held on a user's headwear.

In the embodiment of FIG. 1, the holder 12 may be formed by attaching a cover 30 on an exterior surface 14 of the headwear 10. The cover 30 may be configured as a strip formed of any of various different types of materials. For example, the cover 30 may be formed of a material similar to that of the hat, such as a fabric, or elastic material, leather or any other suitable material known to those skilled in the art. One illustrative embodiment of the cover 30 may be formed as a substantially flat, flexible, polygonal member including a rear edge 32, a front edge 33, an upper edge 35 and a lower edge 36. The front edge 33 may define an entrance to the holder 12 and may be configured to face a front of the headwear 10. The rear edge 32 may be opposite the front edge 33 and may be configured to face a rear of the headwear 10. The cover 30 may be configured to define the holder 12 with a portion of the exterior surface 14 of the headwear 10 to slideably receive the rearmost portion 21 of an article 20 to be stored securely on the headwear 10. It will be understood that other embodiments of the present disclosure may include covers of different shapes and sizes, and that other embodiments may also be oriented in different configurations on the headwear 10, such that the entrance of the holder 12 may extend in different directions in alternative embodiments.

The cover 30 may be attached to the exterior surface 14 of the headwear using stitches 34 or adhesives or any other suitable attaching mechanism known in the art. In one illustrative embodiment, the upper edge 35 and the lower edge 36 may be attached to the headwear 10 along substantially an entire length of the cover 30. Other embodiments of the holder may be attached at intervals along the upper edge 35 and the lower edge 36. Moreover, other embodiments of the present disclosure may include at least a portion of the rear edge 32 attached to the headwear 10.

In the illustrative embodiment of FIG. 1, a gripping means 50 may be disposed on an interior surface of the holder 12 for gripping the article 20. One illustrative embodiment of the gripping means may include VELCRO™ hook and loop fasteners positioned on the exterior surface 14 of the headwear 10 and the interior surface 31 of the cover 30. Accordingly, when a rear portion 21 of an article 20 is placed in the holder 12, the cover 30 may be pressed such that the VELCRO™ hook and loop fasteners connect to provide a space within the holder 12 that more closely corresponds to the shape of the article 20 to assist in holding the article 20 in position within the holder 12. The gripping means 50 may also allow the holder 12 to more securely hold the articles 20 even when the headwear 10 is removed from the user. It will be understood that the gripping means 50 may be sized to cover substantially the entire interior area of the holder 12, or the gripping means 50 may be smaller than the area of the holder 12 so as to cover only a portion of the holder 12. For example, the gripping means may be sized to extend along a half or a third of the cover.

Another illustrative embodiment of the gripping means 50 may include a ductile layer or sheet member within the holder 12. The ductile sheet member may be positioned on an interior surface 31 of the cover 30 and an exterior surface 14 of the headwear 10. Alternatively, the ductile sheet member may be positioned only on the interior surface of the cover 30. The ductile sheet member may be formed of a metal material for example, such as a metal foil, such that the ductile sheet member may be deformed to correspond to the shape of the article 20 and thereby assist in holding the article 20 within the holder 12. The ductile sheet member may be capable of deforming in a plastic manner and may have memory characteristics to remain in the deformed condition. It will be understood that the gripping means 50 may also be formed of any other suitable material for assisting in holding the article 20 within the holder 12. It will be appreciated that many different structures can perform the function of the gripping means 50 and that all structures providing similar or equivalent functions, both those now known to those skilled in the art or which become known, are intended to fall within the scope of gripping means. The structure illustrated herein is merely illustrative of the gripping means which fall within the scope of the present invention.

One illustrative embodiment of the holder 12 may have an elongate configuration for supporting elongate articles 20. For example, the holder may have a length dimension that is longer than the height, such as approximately 1.5 to 3 times the height, or more specifically, a length that is two times the height. One embodiment of the holder 12 may be dimensioned approximately three inches in length and 1.5 inches in height, for example. The reduced dimension of the height as compared to the length may allow the article 20 to be held in position without allowing excessive rotation of the article 20. It will also be understood that alternative storage positions may be possible, as discussed more fully below with regard to FIGS. 21-31. Accordingly, the article 20 may be held securely in place even without the assistance of other structures, such as a visor portion of the headwear 10. Moreover, the holder 12 may be positioned or oriented in other directions and still be able to support the article 20. For example, the holder 12 may be oriented in a direction opposite that shown in FIG. 1, such that the entrance to the holder 12 may face a rear of the headwear 10 or some other direction. Accordingly, the headwear 10 may be worn backwards, as is sometimes done with baseball caps, and still provide support for securely holding articles 20. It will be understood that the holder 12 may be arranged in various different orientations, and may include various different dimensions all which fall within the scope of the present disclosure.

It will be appreciated that in the embodiment of FIG. 1, the holder 12 may be defined at least in part by an interior surface 31 of the cover 30 and an exterior surface 14 of the headwear 10. Other embodiments of the holder 12 will be discussed more fully below.

Figure 2:
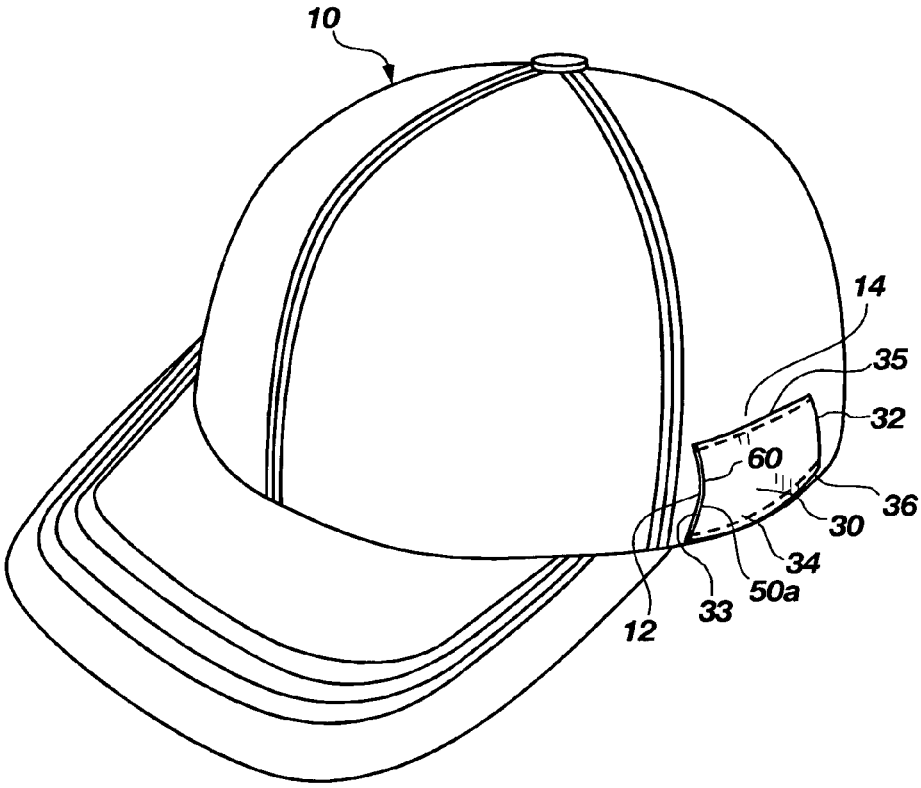
FIG. 2 is a perspective, three-dimensional view of an additional embodiment of the externally mounted utility holder.

Referring to FIG. 2, a perspective view of another illustrative embodiment of the gripping means 50*a* of the present disclosure is shown. It will be understood that the illustrative embodiment depicted in FIG. 2 contains many of the same features as the embodiment disclosed in FIG. 1, and only the pertinent different features will be discussed herein to more succinctly describe the characteristics of the embodiment of the disclosure depicted in FIG. 2.

Shown in FIG. 2, a ductile member 60 may be positioned adjacent the front edge 33 of the cover 30. The ductile member 60 may be in the form of a metal wire, such as a solid gauge copper or tin wire for example, and may extend along substantially the entire dimension of the front edge 33. The ductile member 60 may also extend along at least a portion of the upper edge 35 and/or the lower edge 36 to provide additional support. The ductile member 60 may be attached to the cover by sewing, adhesives, or any other attaching mechanism known to those skilled in the art. It will be understood that the configuration of the ductile member 60 may vary within the scope of the present disclosure as will be appreciated by those skilled in the pertinent art. The ductile member 60 may have various different cross-sectional shapes and dimensions, as well as different lengths.

Some embodiments of the ductile member 60 may be positioned strictly on the front edge 33, while other embodiments of the ductile member 60 may encompass the entire perimeter of the cover 30. Alternatively, the ductile member 60 may be positioned at other locations away from the edges of the cover 30. The ductile member 60 may also allow the holder 12 to more securely hold the articles 20 even when the headwear 10 is removed from the user.

It will be appreciated that, very desirably, the ductile member 60 may be deformed so as to conform to the shape of an article 20 positioned in the holder 12 such that the ductile member 60 may assist in holding the article in place within the holder 12. The ductile member 60 may have plastic deformation characteristics and position memory characteristics such that once deformed, the ductile member may remain in position until acted upon by another deformation force. The benefits of providing the ductile member, or structure performing the same or equivalent functions, to the user will be appreciated by those skilled in the art. Those skilled in the art can readily arrive at additional structures which perform the same or equivalent functions as those carried out by the ductile member, such as those functions carried out by the gripping means disclosed herein.

Referring to FIG. 3, a top view of an illustrative embodiment of the present disclosure is shown in which the externally mounted cover 30 is attached to opposing sides of the headwear 10. Also, the resulting storage position of an article 20, such as a pair of sunglasses is depicted in accordance with the embodiments shown in FIGS. 1 and 2.

Figure 4:
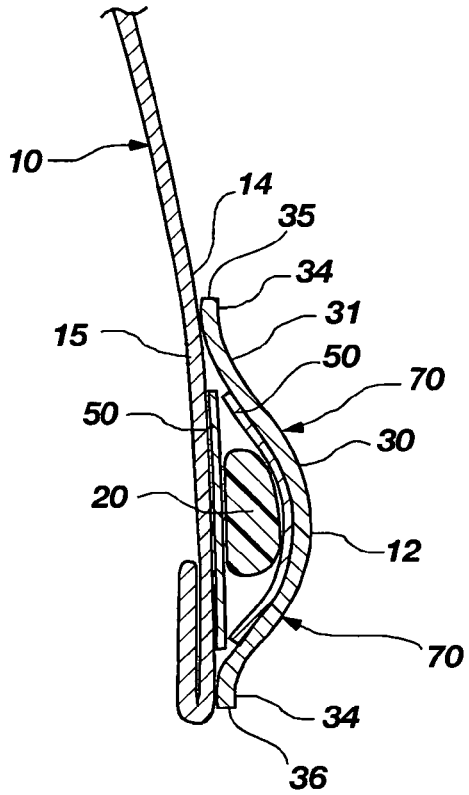
FIG. 4 is a front view of a portion of cross section A-A of the externally mounted utility holder as it is attached to the outside of the headwear, according to the embodiment of FIG. 1 of the disclosure.

Referring to FIG. 4, a partial cross-sectional front view is shown as viewed from line A-A of FIG. 3, showing the embodiment of the gripping means 50 as presented in FIG. 1. The cover 30 may be mounted using stitches 34 or the like to the exterior surface 14 of the headwear 10. In addition, the gripping means 50 is shown disposed between the exterior surface 14 of the headwear 10 and the inner surface of the cover 30. Arrows 70 depict an area where pressure may be applied to the gripping means 50 to modify its shape and facilitate improved hold on an article 20 within the holder 12.

Figure 5:
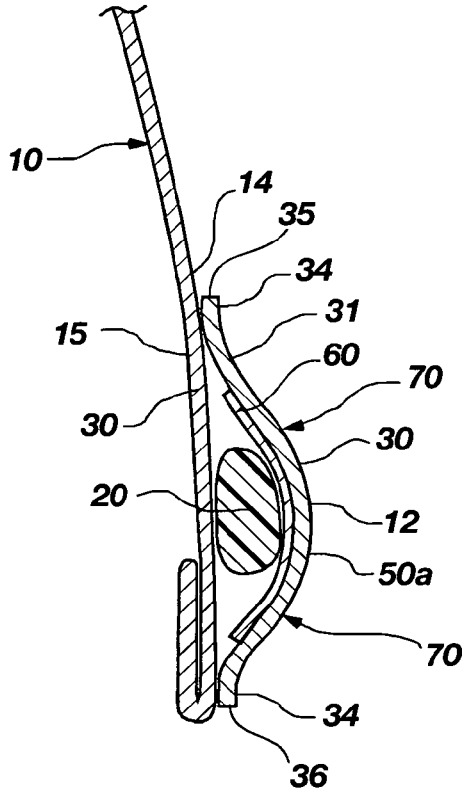
FIG. 5 is a front view of a portion of cross section A-A of the externally mounted utility holder as it is attached to the outside of the headwear, according to the embodiment of FIG. 2 of the disclosure.

Similarly, referring to FIG. 5, a partial cross-sectional front view is shown as viewed from line A-A of FIG. 3, showing the gripping means 50*a* embodiment including the ductile member 60 as presented in FIG. 2. Again, the cover 30 may be mounted using stitches 34 or the like to the outside surface of the headwear 10. In addition, the ductile member 60 is shown disposed on the inner surface of the cover 30. Very desirably, arrows 70 depict an area where pressure may be applied to the ductile member 60 to modify its shape and facilitate improved hold on an article 20.

Figure 6:
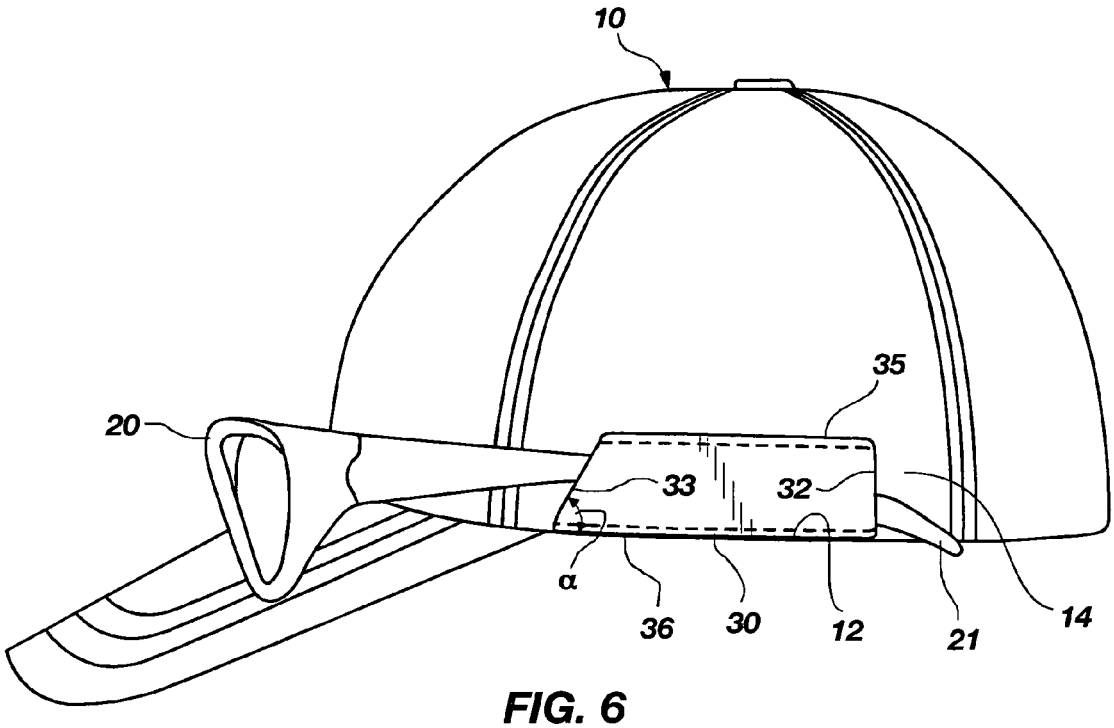
FIG. 6 is a side view showing an externally mounted utility holder assembly depicting a resulting storage position of an article.

Referring now to FIG. 6, a side view of the present disclosure is shown. It will be understood that the illustrative embodiment depicted in FIG. 6 may include the exemplary gripping means 50 as depicted in FIG. 1, or the exemplary gripping means 50*a* including the ductile member 60, as depicted in FIG. 2, or the illustrative embodiment as depicted in FIG. 6 may not include the gripping means 50, 50*a*. The cover 30 may be configured such that the front edge 33 may be disposed at an angle $\alpha$ with respect to the lower edge 36 within a range of between from approximately 30 to approximately 75 degrees. One illustrative embodiment of the front edge 33 may be disposed at an angle $\alpha$ of approximately 60 degrees. It will be appreciated, however, that other illustrative embodiments may include the front edge 33 at different angles $\alpha$ within the scope of the present disclosure. The angle $\alpha$ on the front edge 33 may provide an advantage of allowing for facilitated insertion of the article 20 into the holder 12, particularly when the rear portion 21 of the article 20 is curved downwardly, as is commonly the case with eyewear. The angled front edge 33 may provide a larger entrance to the holder 12 and may facilitate access to the pocket from an upward direction. This may be beneficial for facilitating insertion of articles 20, particularly when the holder 12 is used with headwear 10 having a visor, such as is commonly provided with baseball caps, for example.

Figure 7:
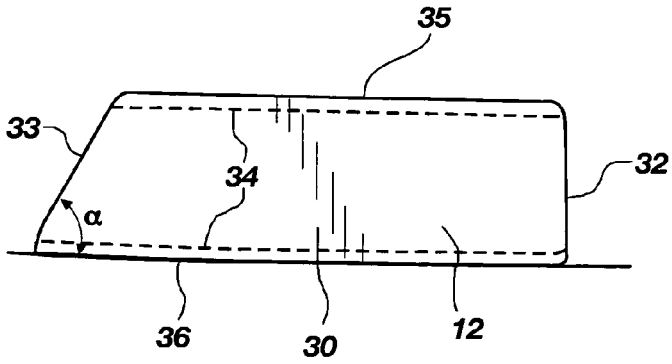
FIG. 7 is a side view showing in greater detail an embodiment of the shape and dimensions of an externally mounted utility holder.

An enlarged view of the holder 12 is depicted in FIG. 7, which shows a detailed side view of the cover 30 of the present disclosure. The front edge 33 is shown disposed at an angle $\alpha$, which may be within a range of from between approximately 30 to approximately 75 degrees, or more specifically, at 60 degrees, for example.

Figure 8:
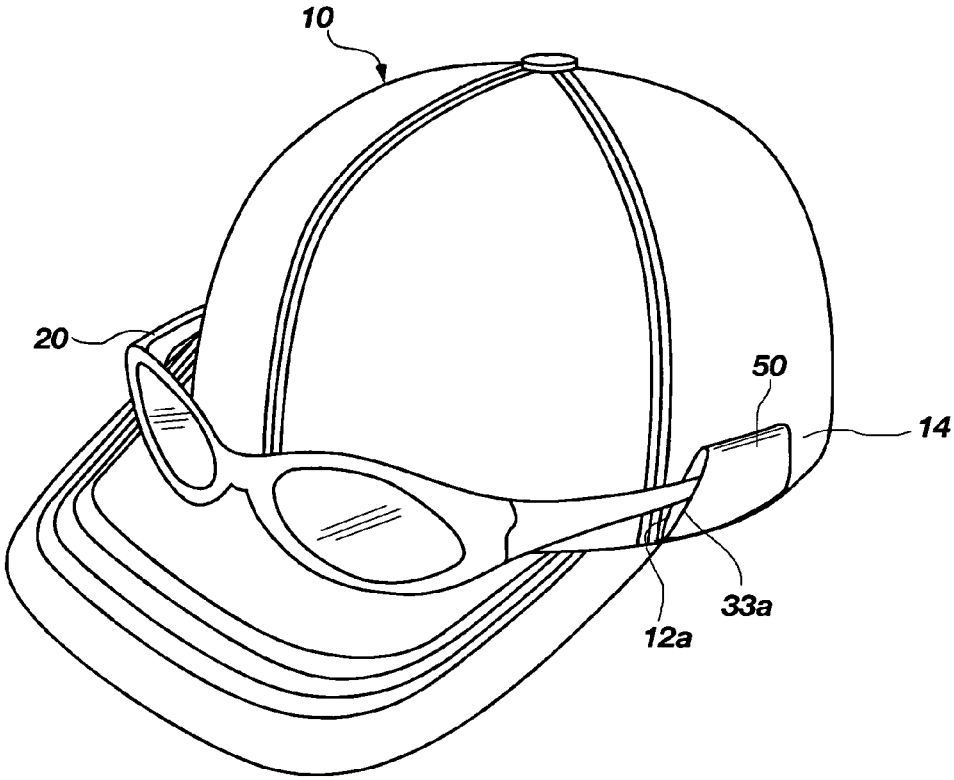
FIG. 8 is a perspective, three-dimensional view of one embodiment of an internally mounted utility holder with an article inserted, according to another embodiment of the present disclosure.
Figure 11:
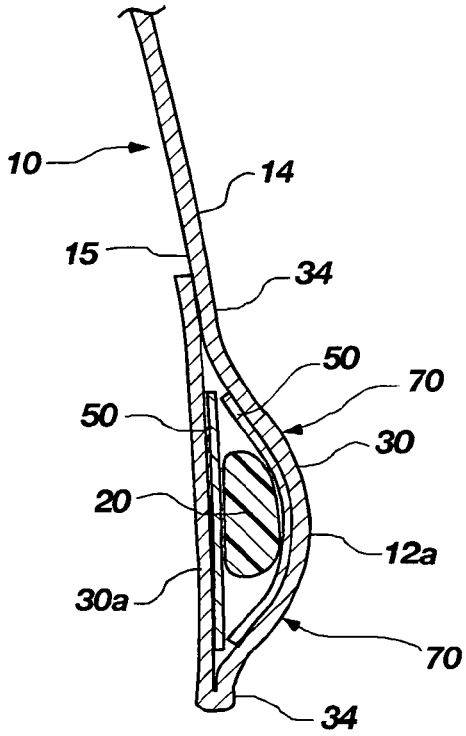
FIG. 11 is a front view of a portion of cross section B-B in FIG. 10, of the internally mounted utility holder assembly as it is mounted to the inside of the headwear, according to the embodiment of FIG. 8.
Figure 12:
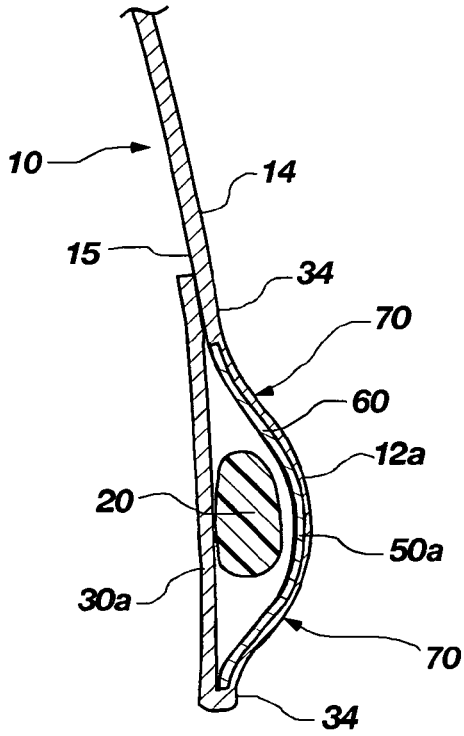
FIG. 12 is a front view of a portion of cross section B-B in FIG. 10, of the internally mounted utility holder assembly as it is mounted to the inside of the headwear, according to the embodiment of FIG. 9.

Referring to FIG. 8, a perspective view of another alternative illustrative embodiment of the present disclosure is shown, in which a holder 12*a* may be disposed on an interior surface 15 of the headwear 10, as shown most clearly in FIGS. 11 and 12. An entrance 33*a* of the holder 12*a* may be defined in the exterior surface 14 of the headwear 10, such that the entrance 33*a* may be the only portion of the holder 12*a* visible from the exterior of the headwear 10. Similar to the previously described illustrative embodiments, the holder 12*a* may be configured to slideably receive the rearmost portion 21 of an article 20 to be stored securely. In addition, similar to the illustrative embodiment of FIG. 1, a gripping means 50, such as a VELCRO™ hook and loop fastener or a layer with a plastic memory capability, such as foil, or other similar material may be mounted on the inside surfaces of the holder 12*a*.

Figure 9:
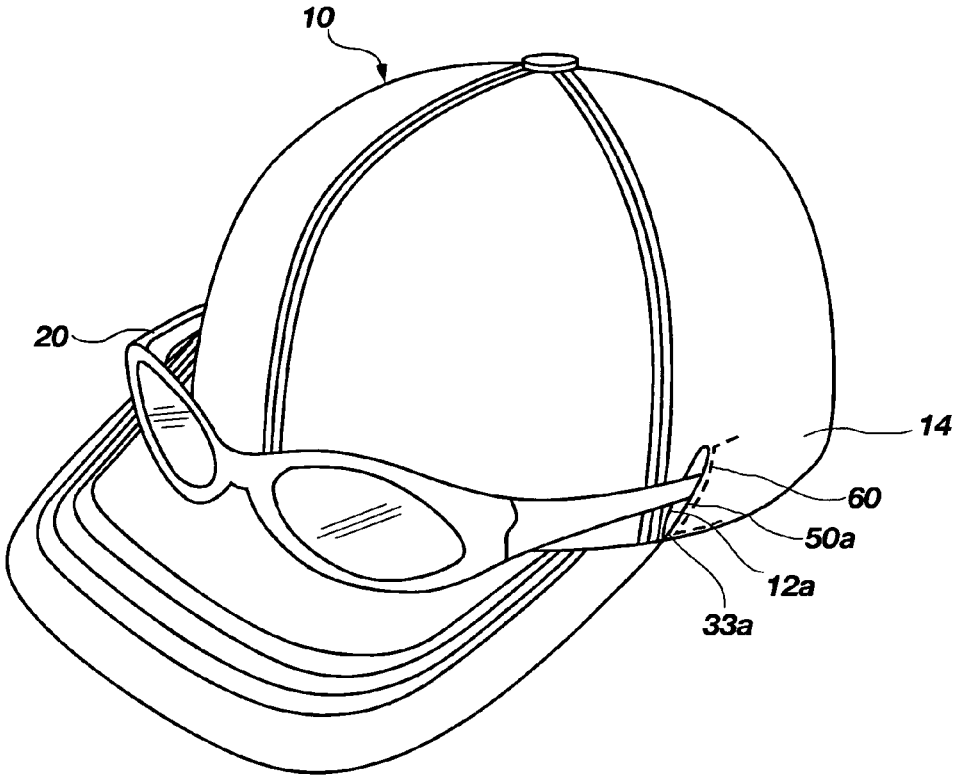
FIG. 9 is a perspective, three-dimensional view of another embodiment of an internally mounted utility holder with an article inserted, according to the principles of the present disclosure.

Similarly, as shown in FIG. 9, which shows a perspective view of another illustrative embodiment of the present disclosure, the headwear 10 may include a holder 12 designed to slideably receive the rearmost portion 21 of an article 20 to be stored securely in the pocket. In addition, a gripping means 50*a* (shown in phantom image in FIG. 9) in the form of a ductile member 60 having a plastic memory capability, such as a wire, or other similar material, may be mounted inside the holder 12 at the front edge 33, similar to the embodiment of FIG. 2, except that the holder 12*a* may be provided on an interior of the headwear 10.

Figure 10:
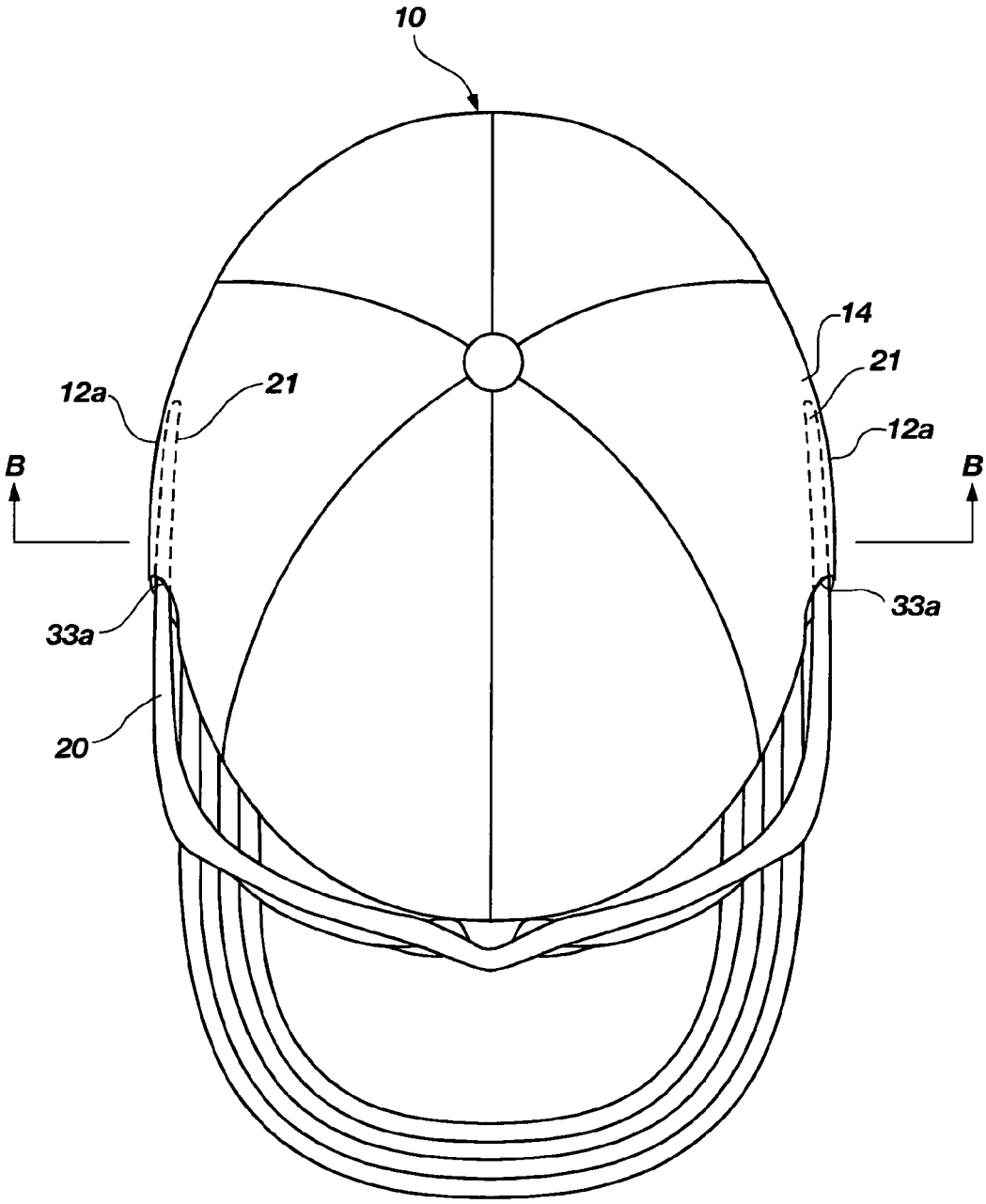
FIG. 10 is a top view of the internally mounted utility holder as depicted in the embodiments of FIGS. 8 and 9 and the resulting storage position of an article.

Referring now to FIG. 10, a top view of the present disclosure is shown in which the internally mounted holder 12*a* is dispose on opposing sides of the headwear 10. Also, the resulting storage position of an article 20, such as a pair of sunglasses is depicted in accordance with the embodiments shown in FIGS. 8 and 9.

Referring to FIG. 11, a partial cross-sectional front view is shown as viewed from line B-B of FIG. 10, showing the illustrative embodiment of the gripping means 50 as presented in FIG. 8. The gripping means 50 is shown disposed on an interior of the holder 12*a*, on an interior side of the headwear 10. Arrows 70 depict an area where pressure may be applied to the gripping means 50 to modify its shape and facilitate improved hold on an article 20.

An interior cover 30*a* may be provided on an interior side of the headwear 10 to define a pocket for receiving the article 20, and to protect the user's head from contact with the article 20. The interior cover 30*a* may be attached to the headwear 10 using stitches 34 or any other type of connecting mechanism, similar to the previously described embodiments. The interior cover 30*a* may be configured to extend to substantially an entire dimension of the article 20. Alternatively, the interior cover 30*a* may be configured to cover only a portion of the article 20. One illustrative embodiment of the interior cover 30*a* may have an elongate configuration for supporting elongate articles 20. For example, similar to previously described embodiments, the interior cover 30*a* may have a polygonal shape having a length dimension that is longer than the height, such as approximately 1.5 to 3 times the height, or more specifically, a length that is two times the height. One illustrative embodiment of the interior cover 30*a* may be dimensioned approximately three inches in length and 1.5 inches in height, for example. The reduced dimension of the height as compared to the length may allow elongate articles 20 to be held in position without allowing excessive rotation of the article 20 or contact with the user's head. Accordingly, the article 20 may be held securely in place even without the assistance of other structures. Moreover, it will also be understood that some embodiments of the present disclosure may be provided such that the holder 12*a* may be provided without an interior cover 30*a*, such that the article 20 may be exposed on the interior surface 15 of the headwear 10.

Similarly, referring to FIG. 12, a partial cross-sectional front view is shown as viewed from line B-B of FIG. 10, showing the illustrative embodiment of the gripping means 50*a* including the ductile member 60 as presented in FIG. 9. The ductile member 60 may be mounted inside a seam or surface of the holder 12*a*. Points 70 depict an area to apply pressure to the ductile member 60 to modify its shape to facilitate improved hold on an article 20.

Figure 13:
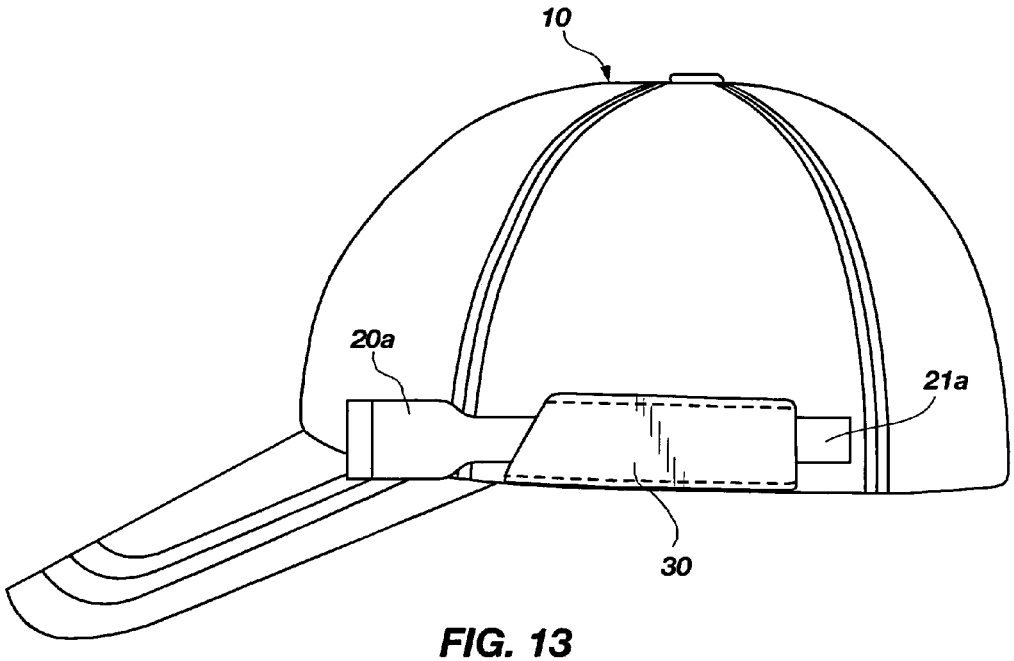
FIG. 13 is a side view showing the utility holder assembly and a resulting storage position of an article, such as a small flashlight, according the embodiments of the disclosure of FIG. 1 or 2.

Referring now to FIG. 13, a side view is shown, wherein a headwear 10 comprises the holder 30. The resulting storage position of an article 20*a*, such as a flashlight, is also depicted. It will be understood that a gripping means 50, 50*a* may also be provided in the holder 30, within the scope of the present disclosure.

Figure 14:
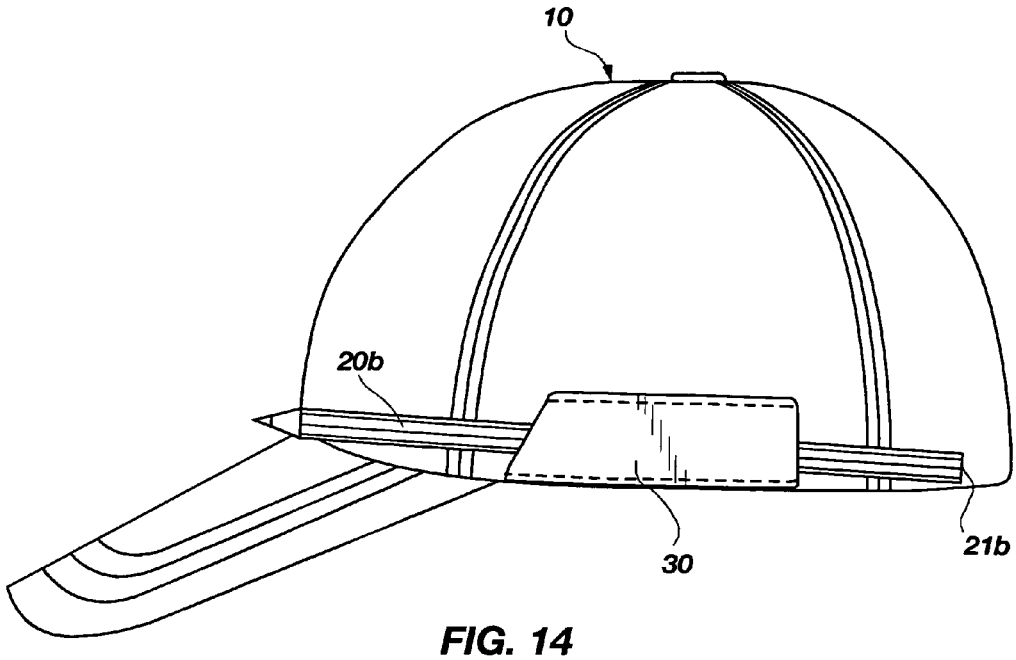
FIG. 14 is a side view showing the utility holder assembly and a resulting storage position of an article, such as a pencil, according the embodiments of the disclosure of FIG. 1 or 2.

Referring next to FIG. 14, a side view is shown, wherein the headwear 10 comprises the holder 30. The resulting storage position of an article 20*b*, such as a writing utensil or pencil, is also depicted. Similar to the illustrative embodiments previously discussed, it will be understood that a gripping means, such as gripping means 50 or gripping means 50*a*, may also be provided in the holder 30, within the scope of the present disclosure, though such may not be visible in the depiction of FIG. 14.

Figure 15:
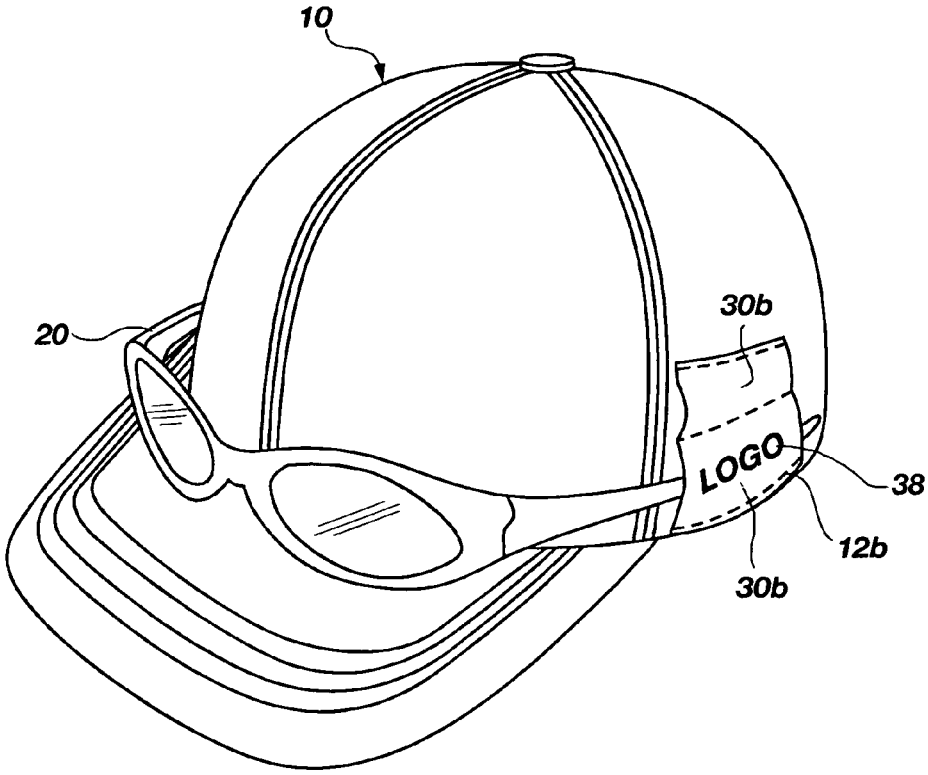
FIG. 15 is a perspective, three-dimensional view of an embodiment of a utility holder having a plurality of pockets mounted to headwear in accordance with the principles of the present disclosure.

Referring now to FIG. 15, a perspective view is shown of an additional embodiment of the present disclosure in which a holder 12*b* may be provided with a plurality of pockets 16 for receiving multiple articles 20. For example, the holder 12*b* may be utilized to hold an article 20 in the form of a pair of sunglasses, as well as an article 20*b* in the form of a pencil, at the same time. It will be understood that the holder 12*b* may be attached to the headwear 10 in a manner similar to the embodiments previously discussed. Moreover, similar to the previously discussed embodiments, the holder 12*b* may include a gripping means, such as gripping means 50 or gripping means 50*a*, to facilitate securing the article 20 to the headwear 10.

Also as shown in FIG. 15, a logo, product information, or any other variety of indicia 38 may be applied to the holder 12*b*. The indica 38 may be beneficial for advertising or may be decorative in nature to improve the aesthetic appearance of the holder 12*b*. It will be understood that each of the illustrative embodiments of the present disclosure may include the indica 38 as depicted schematically in FIG. 15 and may also include a plurality of compartments for holding a plurality of articles simultaneously.

Figure 16:
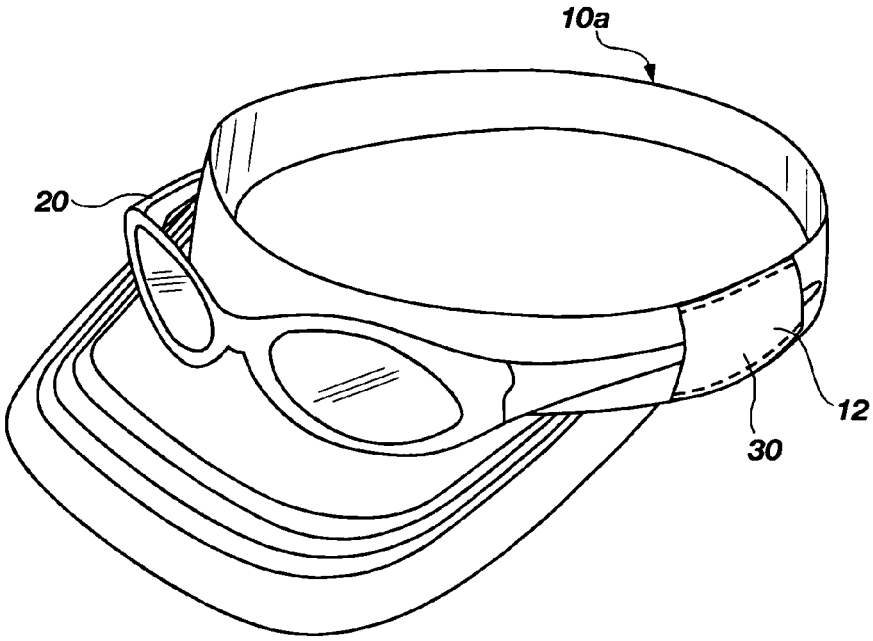
FIG. 16 is a perspective, three-dimensional view of an embodiment of the utility holder mounted to visor style headwear.

Referring now to FIG. 16, a perspective view is shown of headwear 10*a* in the form of a visor, including the holder 12 in accordance with the principles of the present disclosure. The depiction of the headwear 10*a* in the form of a visor is intended to illustrate that the principles of the present disclosure may be utilized with various different types of headwear. Though the depiction of FIG. 16 includes an externally mounted cover 30 to form the holder 12, it will be understood that an internal holder 12*a* may also be used with the headwear 10*a*. Moreover, though an article 20, in the form of sunglasses, is depicted in FIG. 16, it will be understood that various different varieties of articles may be held on the headwear 10*a*.

Figure 17:
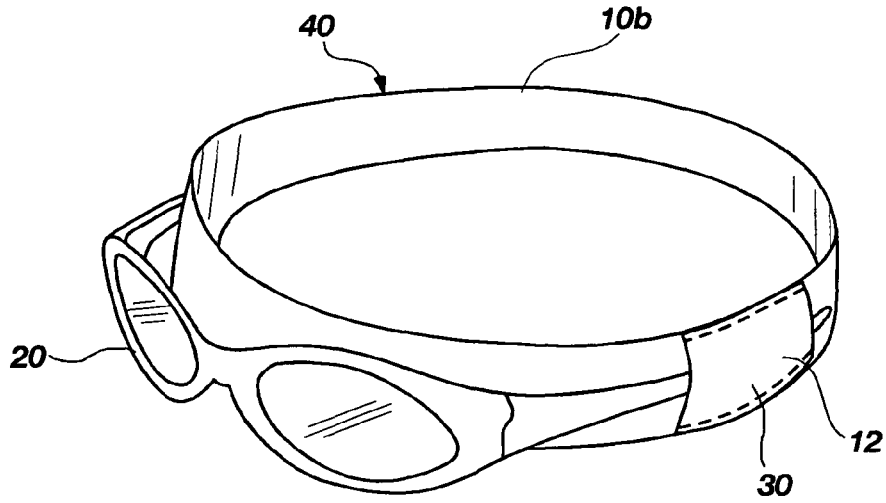
FIG. 17 is a perspective, three-dimensional view of an embodiment of the utility holder assembly mounted to an elastic type headband.

Referring to FIG. 17, a perspective view of an additional variety of headwear 10*b*, in the form of a headband 40, is shown. The headband 40 may be formed of an elastic material to allow the headband 40 to expand and contract to adjust in size. A holder 12 may be positioned on the headband 40 to receive various different kinds of articles 20. It will be understood that the headband 40 may be similarly equipped with an internal holder 12*a*, as described herein. Moreover, similar to the previously discussed embodiments, the holder 12 may include a gripping means, such as gripping means 50 or gripping means 50*a*, to facilitate securing the article 20 to the headwear 10*b*.

Figure 18:
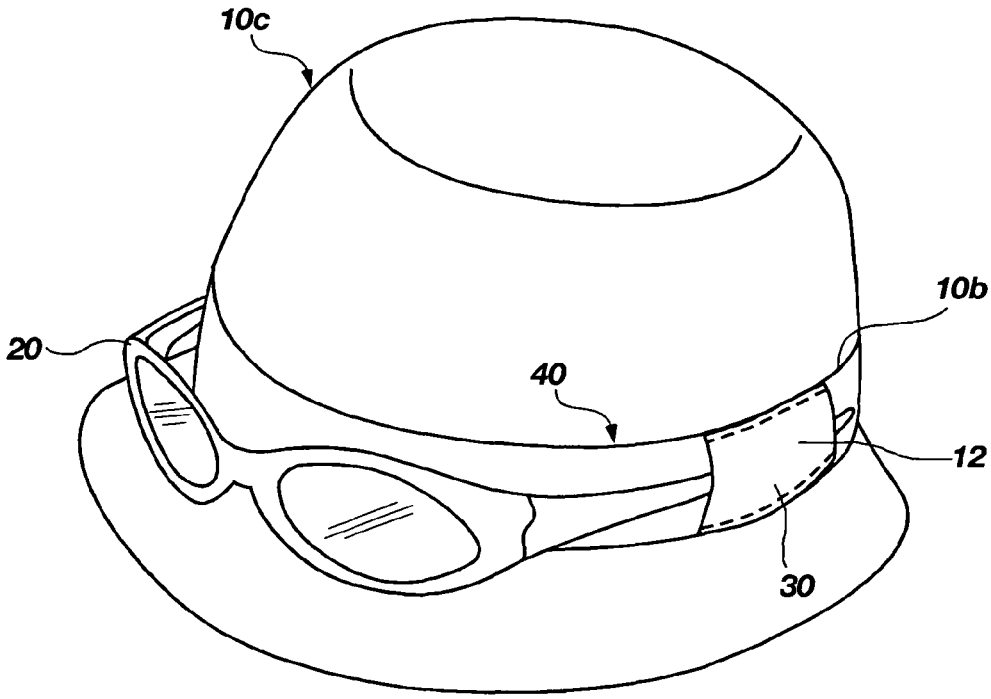
FIG. 18 is a perspective, three-dimensional view of an embodiment of the utility holder assembly mounted to a headband, which is attached interchangeably to various type and styles of headwear, according to the further embodiment of the present disclosure.

Referring now to FIG. 18, a perspective view is shown of yet an additional type of headwear 10*c*, in the form of a hat having the headband 40 placed thereon. It will be understood that various different styles of headwear 10*c* may be provided and the headband 40 my be removably attached to the headwear 10*c*, or the headband 40 may be fixed to the headwear 10*c*. Moreover, the holder, such as holder 12 or holder 12*a*, may be directly disposed on the headwear 10*c* without the headband 40. Accordingly, the principles of the present disclosure may be versatile such that various different combinations of headwear may be utilized to hold an article 20 to the headwear corresponding to the needs or desired styles for a particular user.

Figure 19:
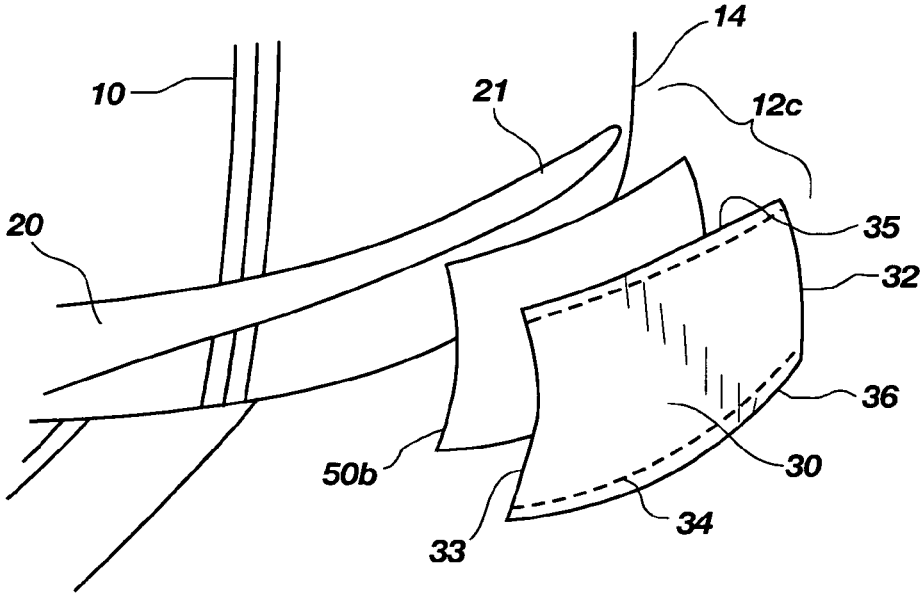
FIG. 19 is a break-away perspective, three-dimensional exploded view of another embodiment of an externally mounted utility holder with an article inserted.

Referring to FIG. 19, a break-away perspective view of another embodiment of a holder, indicated by bracket 12*c*, is shown in an exploded view. It will be understood that the illustrative embodiment depicted in FIG. 19 contains many of the same features as the embodiments discussed above, and only the pertinent different features will be discussed herein to more succinctly describe the characteristics of the embodiment of the disclosure depicted in FIG. 19.

FIG. 19 depicts another illustrative embodiment of the gripping means 50*b* of the present disclosure. The gripping means 50*b* may include a material configured for gripping the article 20, such as a piece of foam rubber, disposed within the holder 12*c*. It will be understood that other materials known in the art for improving the ability of the holder 12*c* to grip the article 20 may be used. The foam rubber gripping means 50*b* may be allowed to compress to form a tighter contact with the article 20. Moreover, the foam rubber material may allow the holder 12*c* to contact the article 20 such that the frictional characteristics of the holder 12*c* may be improved to prevent the article 20 from sliding out of the holder.

Figure 20:
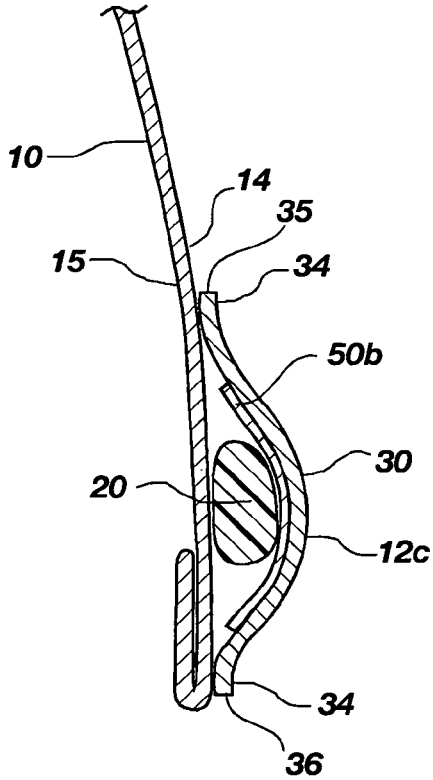
FIG. 20 is a front cross-sectional view of the externally mounted utility holder as it is attached to the outside of the headwear, according to the embodiment of FIG. 19 of the disclosure.

As shown in FIG. 20, which shows a cross-sectional view of the holder 12*c*, the gripping means 50*b* may be disposed on an interior side of the cover 30. However, it will also be understood that the gripping means 50*b* may also, or alternatively, be disposed on the exterior surface 14 of the headwear 10, or the gripping means 50*b* may be utilized in the alternative embodiment holders 12*a*, or 12*b*.

Referring to FIGS. 21-24, a break-away side view of another embodiment of a holder 12*d* is shown. It will be understood that the illustrative embodiment depicted in FIGS. 21-24 contains many of the same features as the embodiments discussed above, and only the pertinent different features will be discussed herein to more succinctly describe the characteristics of the embodiment of the disclosure depicted in FIGS. 21-24.

Figure 21:
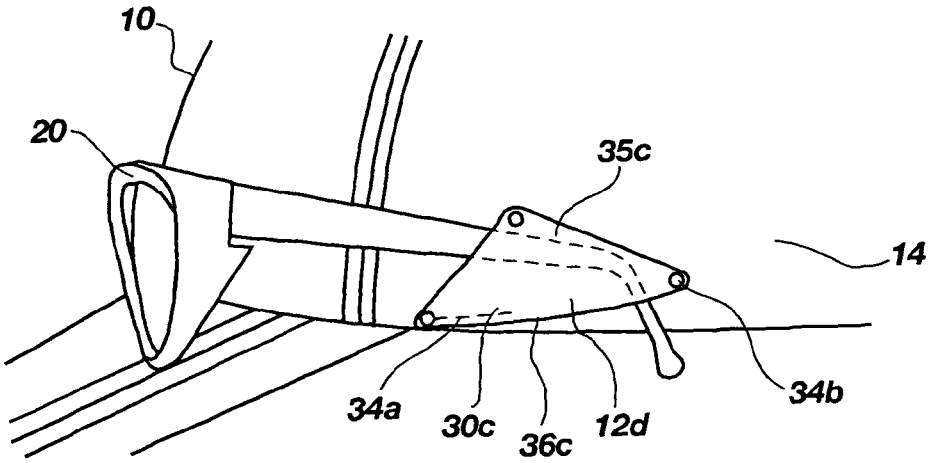
FIG. 21 is a break-away side view of an additional embodiment externally mounted utility holder assembly depicting a resulting storage position of an article.
Figure 22:
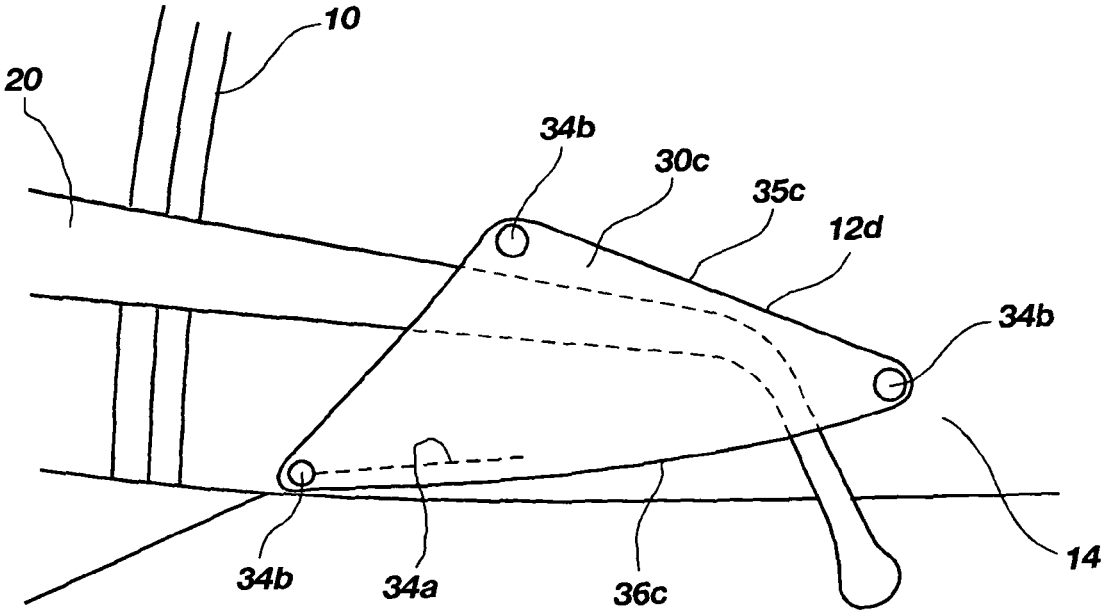
FIG. 22 is a break-away side view showing the externally mounted utility holder of FIG. 21 enlarged.
Figure 23:
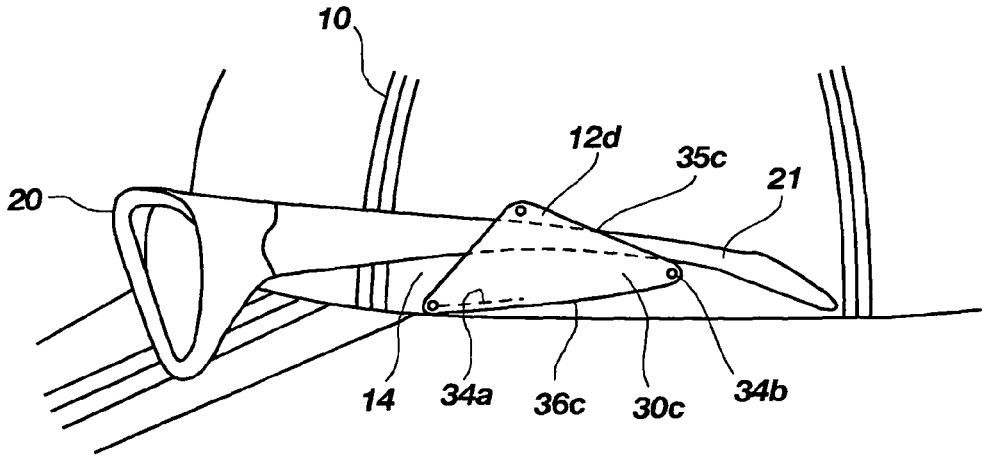
FIG. 23 is a break-away side view of the externally mounted utility holder assembly embodiment of FIG. 21, depicting a resulting storage position of an alternative embodiment article.
Figure 24:
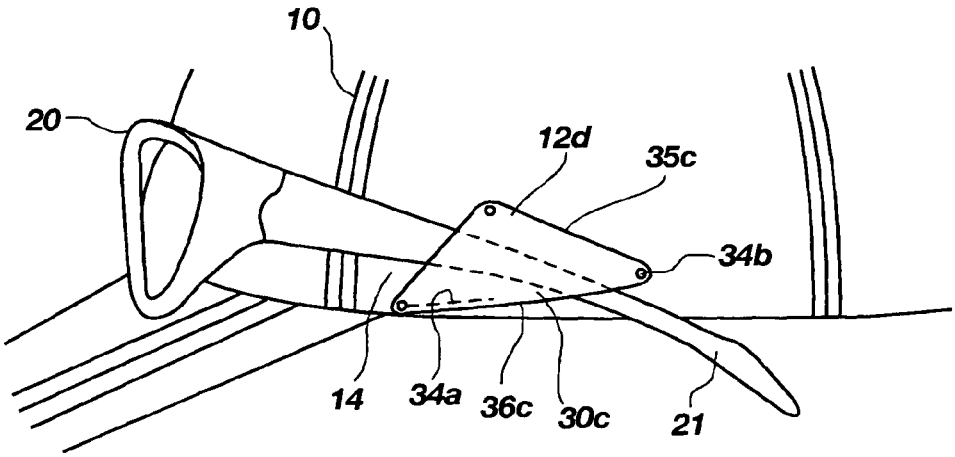
FIG. 24 is a break-away side view of the externally mounted utility holder assembly embodiment of FIG. 21, depicting an alternative storage position of an article.

The holder 12*d* may include a cover 30*c* that may be somewhat triangular in shape. The cover 30*c* may be attached to the exterior surface 14 of the headwear 10 by a continuous stitching 34*a* extending along a portion or all of a lower edge 36*c* of the cover 30*c*. The cover 30*c* may also be attached to the headwear 10 using point or area stitches 34*b*, or other attachment mechanisms known in the art, which may be positioned at corners of the cover 30*c*. It will be understood that the embodiment of the holder 12*d* as depicted in FIGS. 21-24 may include the cover 30*c* which allows access to an interior of the holder 12*d* through the upper edge 35*c* and the lower edge 36*c*, as well as the front edge 33*c*. Accordingly, the article 20 may be stored in the holder 12*d* in various different positions. For example, an article 20 having a curved temple or earpiece, as is common in eyeglasses, may extend through the lower edge 36, as shown in FIGS. 21 and 22. Articles 20 having somewhat straight rearmost portions 21 may also be positioned to extend through the lower edge 36*c* as shown in FIG. 24. Alternatively, the articles 20 may be positioned to extend through the upper edge 35*c* as shown in FIG. 23.

It will be understood that the cover 30*c* may have various different shapes within the scope of the present disclosure, and that the cover 30*c* may be attached to the headwear 10 using various different stitch configurations or other attachment mechanisms. For example, one embodiment of the present disclosure may not include the continuous stitches 34*a*, or the continuous stitches 34*a* may extend a different percentage of the lower edge 36*c* or upper edge 35*c*.

Figure 25:
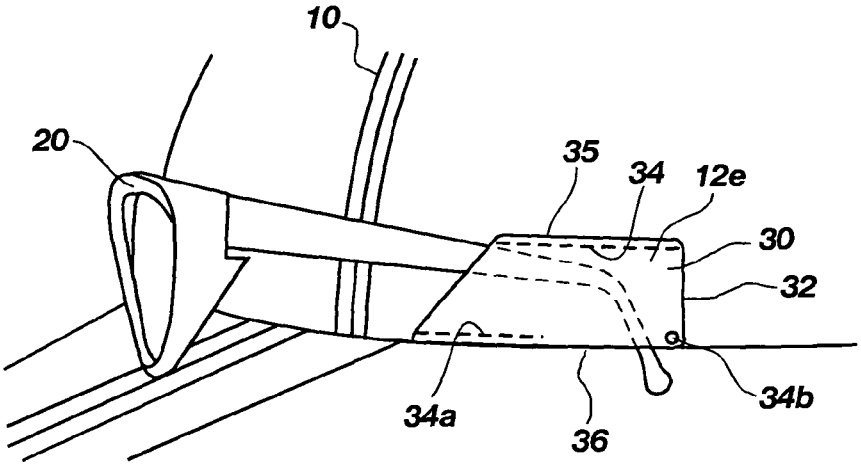
FIG. 25 is a break-away side view of an additional embodiment externally mounted utility holder assembly depicting a resulting storage position of an article.
Figure 26:
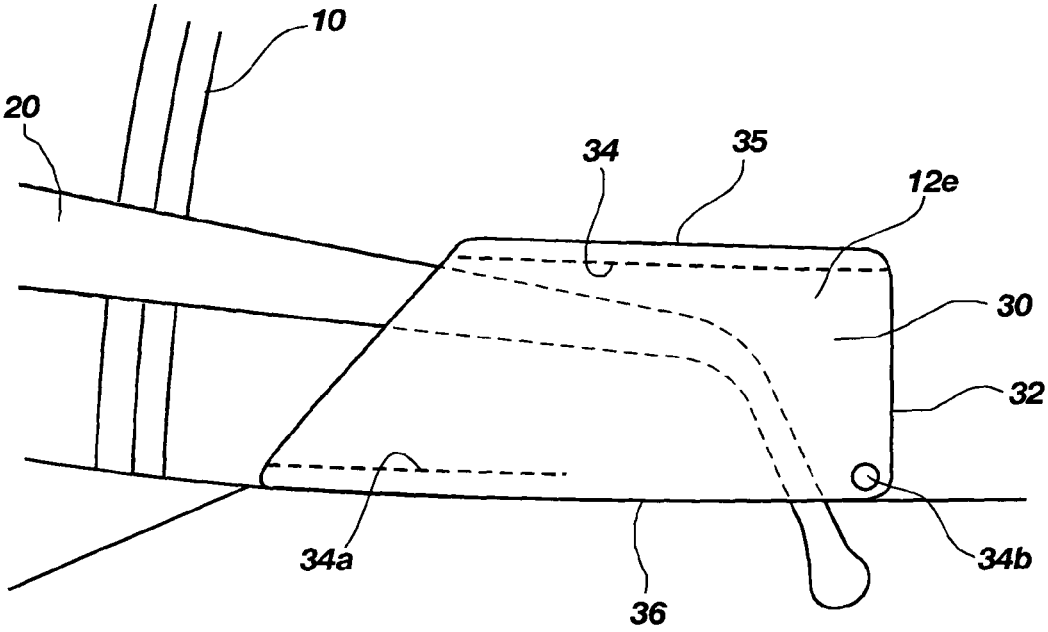
FIG. 26 is a break-away side view showing the externally mounted utility holder of FIG. 25 enlarged.
Figure 27:
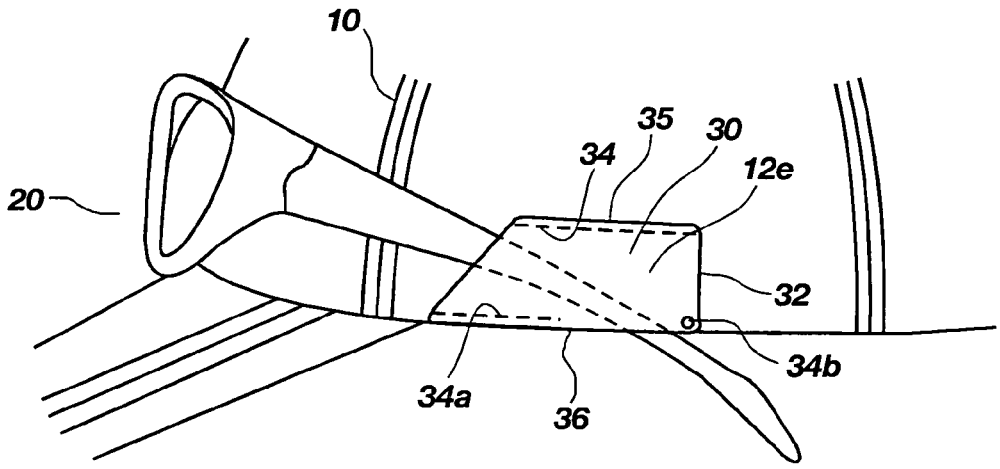
FIG. 27 is a break-away side view of the externally mounted utility holder assembly embodiment of FIG. 25, depicting a resulting storage position of an alternative embodiment article.
Figure 28:
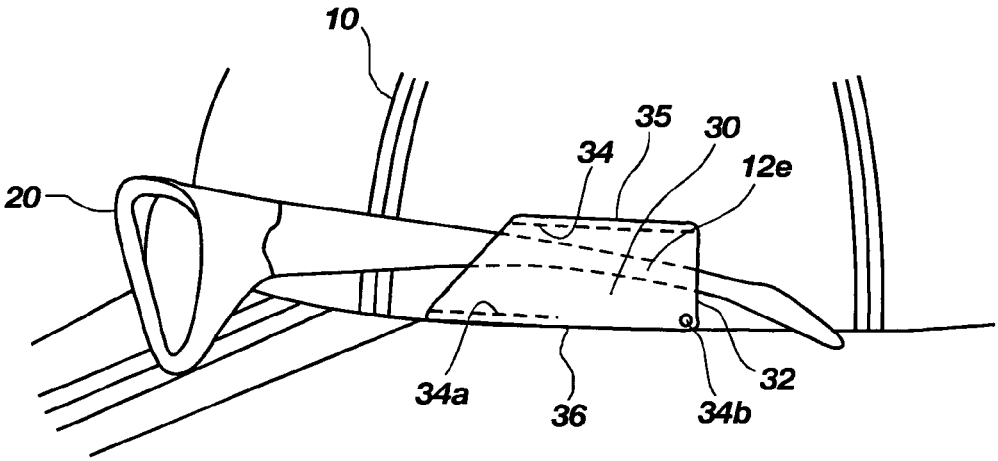
FIG. 28 is a break-away side view of the externally mounted utility holder assembly embodiment of FIG. 25, depicting an alternative storage position of an article.

As shown most clearly in FIGS. 25-28, the continuous stitches 34*a* and point stitches 34*b* may also be used to connect the cover 30 to the headwear 10 to create yet another embodiment of the holder, as indicated at 12*e*. Accordingly, the lower edge 36 may include an opening for allowing the article 20 to pass therethrough, as shown in FIGS. 25-27. Alternatively, the article 20 may be allowed to pass through the rear edge 32, as shown in FIG. 28. Accordingly, the holder 12*e* may be very versatile to accommodate articles 20 of various different configurations in various different positions.

Figure 29:
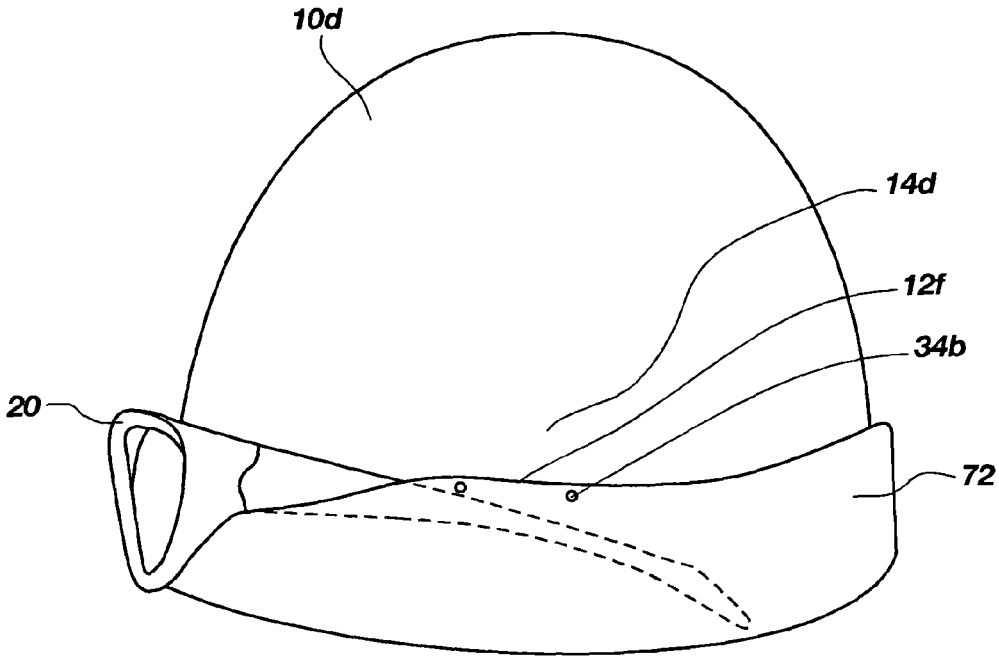
FIG. 29 is a side view of a further embodiment utility holder assembly depicting a resulting storage position of an article.
Figure 30:
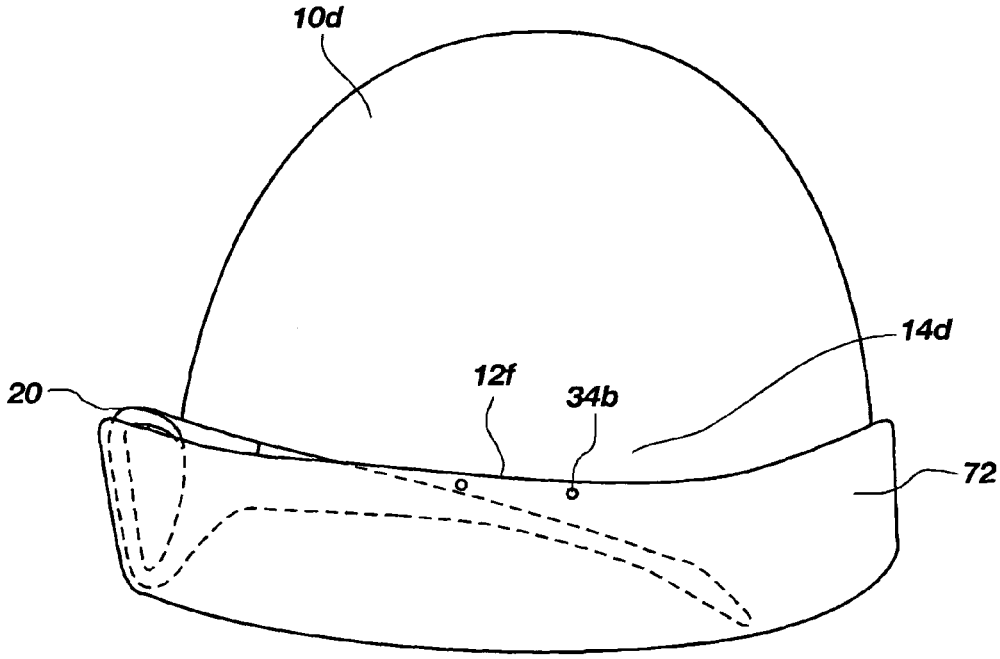
FIG. 30 is an enlarged break-away side view showing the utility holder of FIG. 29 and an alternative storage position of an article.
Figure 31:
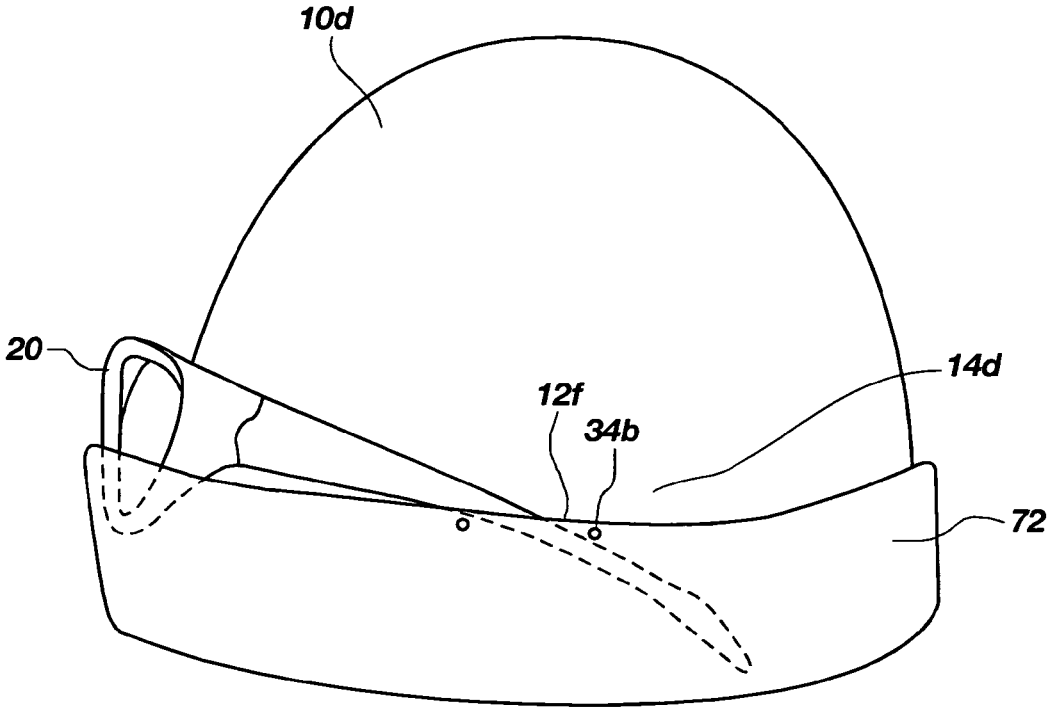
FIG. 31 is an enlarged break-away side view showing the utility holder of FIG. 29 and an additional alternative storage position of an article.

Referring now to FIGS. 29-31, yet another embodiment of the holder is shown, as indicated at 12*f*. The holder 12*f* may be particularly well suited for headwear 10*d* in the form of ski caps. It will be understood that the illustrative embodiment depicted in FIGS. 29-31 contains many of the same features as the embodiments discussed above, and only the pertinent different features will be discussed herein to more succinctly describe the characteristics of the embodiment of the disclosure depicted in FIGS. 29-31.

Point stitches 34*b* may be used to attach a rim portion 72 of the headwear 10*d* to an exterior surface 14*d* of the headwear 10*d*. For example, in one embodiment, a pair of point stitches 34*b*, or other attaching mechanisms, may be attached to the rim portion 72 such that the holder 12*f* may be defined between the rim portion 72, the exterior surface 14*d* of the headwear 10*d*, and the point stitches 34*b*. Accordingly, the article 20 may be held to the headwear 10*d* in various different positions. For example, the article 20 may be held to be partially outside the rim portion 72 and partially between the rim portion 72 and the exterior surface 14*d* of the headwear 10*d* below the point stitches 34*b*, as shown most clearly in FIG. 29. Alternatively, the article 20 may be substantially completely held between the rim portion 72 and the exterior surface of the headwear 10*d*, as best shown in FIG. 30. The point stitches 34*b* may thereby be positioned above the article 20 to maintain the article 20 in position on the headwear 10*d*. Also, as shown most clearly in FIG. 31, the article 20 may be positioned between the point stitches 34*b* to extend partially outside the holder 12*f*.

It will be understood that point stitches 34*b* may be positioned in various different locations, and various different quantities of point stitches 34*b* may be used to provide holders 12*f* in a desired configuration. For example, three point stitches 34*b* may be provided to create a triangular holder 12*f*, or four point stitches 34*b* may be used to create a polygonal holder 12*f*. It will also be understood that the term "point stitch" as used herein shall be construed to include stitches that cover an area, which may appear as a point from a distance, such that the point stitch may not include an entire dimension of the object being stitched. Accordingly, point stitches may include multiple stitches, or strands in various different shapes, such that point stitches are not limited to a single stitch. Similarly, other attaching mechanisms known in the art may be used as an alternative to stitches.

It will be understood that any number of holders 12 may be used on the headwear 10, and that each of the holders 12 may be substantially identical, or each of the holders 12 may comprise different features as described above. Moreover, it will be understood that the features of the present disclosure may be manufactured using techniques known to those skilled in the art.

It will be appreciated that the structure and apparatus disclosed herein is merely one example of a means for gripping an article, and it should be appreciated that any structure, apparatus or system for gripping an article which performs functions the same as, or equivalent to, those disclosed herein are intended to fall within the scope of a means for gripping an article, including those structures, apparatus or systems for gripping articles which are presently known, or which may become available in the future. Anything which functions the same as, or equivalently to, a means for gripping and article falls within the scope of this element.

In accordance with the features and combinations described above, a useful method of holding an article on headwear includes the steps of:

(a) joining a holder to the headwear;

(b) placing the article in the holder;

(c) deforming a portion of the holder to correspond to the configuration of the article, such as by pressing the holder.

Figure 32:
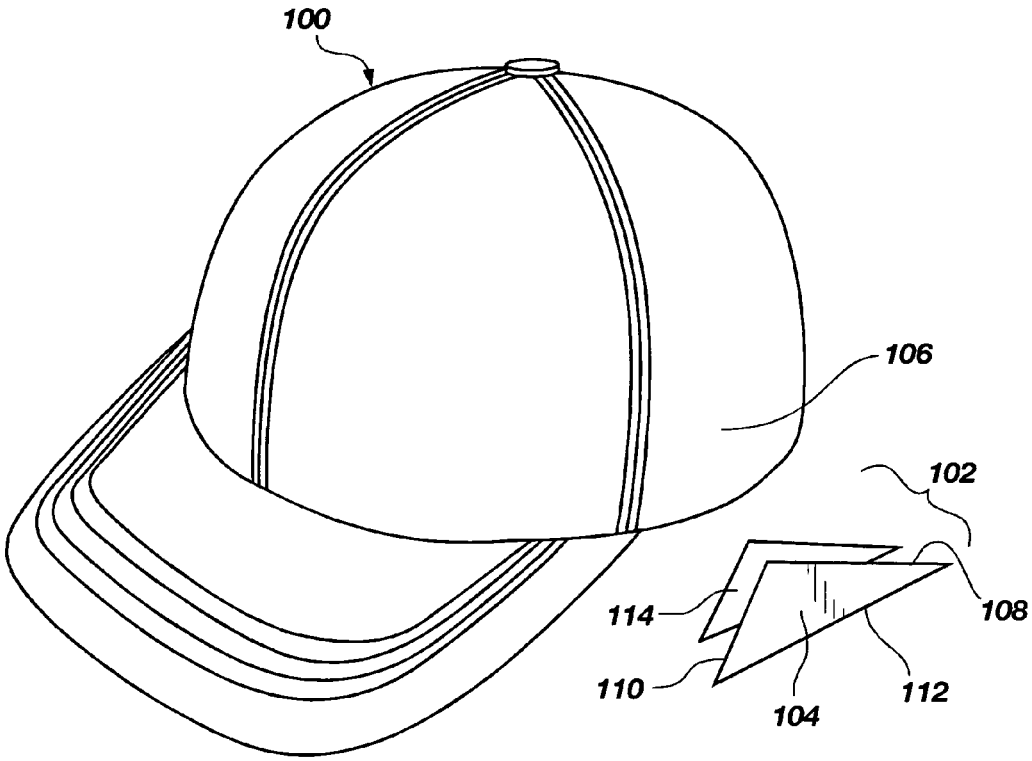
FIG. 32 is a perspective, three-dimensional exploded view of one embodiment of an externally mounted utility holder with a spring.

Referring now to FIG. 32, a perspective view of another illustrative embodiment of the present disclosure is shown, including a headwear member, indicated generally at 100. A holder, indicated by bracket 102 as shown in an exploded view in FIG. 32, may be disposed on one or more sides of the headwear member 100 for receiving an article, such as sunglasses. For example, a second holder may be positioned on an opposite side of the headwear 100 so that opposing temples of the sunglasses may each be received in a holder 102.

In the embodiment of FIG. 32, the holder 102 may be formed by attaching a cover 104 on an exterior surface 106 of the headwear 100. The cover 104 may be configured as a strip formed of any of various different types of materials. For example, the cover 104 may be formed of a material similar to that of the hat, such as a fabric, or elastic material, leather or any other suitable material known to those skilled in the art. One illustrative embodiment of the cover 104 may be formed as a substantially flat, flexible, polygonal member, such as a triangle, including a rear edge 108, a front edge 110, and a lower edge 112. In an illustrative embodiment, the cover 104 may have a substantially triangular shape.

The front edge 110 may define an entrance to the holder 102 and may be configured to face a front of the headwear 100. The rear edge 108 may be opposite the front edge 110 and may be configured to face a rear of the headwear 100. The cover 104 may be configured to define the holder 102 with a portion of the exterior surface 106 of the headwear 100 to slideably receive a rearmost portion of an article to be stored securely on the headwear 100. It will be understood that other embodiments of the present disclosure may include covers of different shapes and sizes, and that other embodiments may also be oriented in different configurations on the headwear 100, such that the entrance of the holder 102 may extend in different directions in alternative embodiments. The cover 104 may be attached to the exterior surface 106 of the headwear 100 using stitches or adhesives or any other suitable attaching mechanism known in the art.

In the illustrative embodiment of FIG. 32, a spring 114 may be disposed on an interior surface of the holder 102 for preventing deformation of the cover 104. In one embodiment, the spring 114 may be mounted inside of the holder 102 either to the cover or the headwear 100. In another embodiment, the spring 114 may be enclosed or wrapped entirely within the cover 104. For example, the cover 104 may be doubled in half, with the spring 114 disposed within the folded interior of the cover 104. Alternatively, a pocket may be formed inside of the cover 104. The spring 114 may be slid into the pocket. Also, two pieces of material may be used to form the cover 104, and the spring 114 may be disposed between the two pieces of material. In still another embodiment, the spring 114 is enclosed or wrapped entirely within the headwear 100.

The spring 114 may be formed from a suitable resilient material such as plastic or metal and have a triangular shape. The spring 114 prevents the release of articles held in the holder 102, especially when the headwear 100 has been removed from a user's head. The spring 114 maintains the shape of the holder 102 which would otherwise collapse or fold when the headwear 100 has been removed from a user's head. The collapsing or folding of the holder 102 would occur when the cover 104 is formed from a pliable material such as cloth. Thus, this embodiment is an advantage over the prior art due to the fact that often times a user will forget that an article has been placed in holder 102. When the user removes the headwear 100, the use of spring 114 resists the deformation or collapse of the holder 102 to thereby maintain the article securely attached to the headwear 100. In particular, the spring 114 prevents or resists the front edge 110 and rear edge 108 from collapsing or crumpling onto the bottom edge 112, especially when the headwear 100 has been removed from a user's head. The resilient nature of spring 114 ensures that the holder 102 will return to its normal position even in the event that the holder 102 is deformed for some reason. Thus, in some embodiments spring 114 will have little or no memory when deformed. Further, the spring 114 resists a compression force on its edges. While the spring 114 may bow under the compression force, the resilient nature of the spring 114 allows it to return to its normal shape.

Further, by preventing deformation of the holder 102, the holder 102 stays in close proximity to the exterior surface 106 of the headwear. This close proximity allows any article disposed in the holder 102 to be held in place by the action of spring 114. It will be appreciated that without the use of spring 114, the cover 104 may sag or otherwise separate away from the exterior surface 106 of the headwear 100, especially when the headwear 100 has been removed from a user's head. This sagging or separation may allow any article held in the holder 102 to fall to the ground and be damaged.

Figure 33:
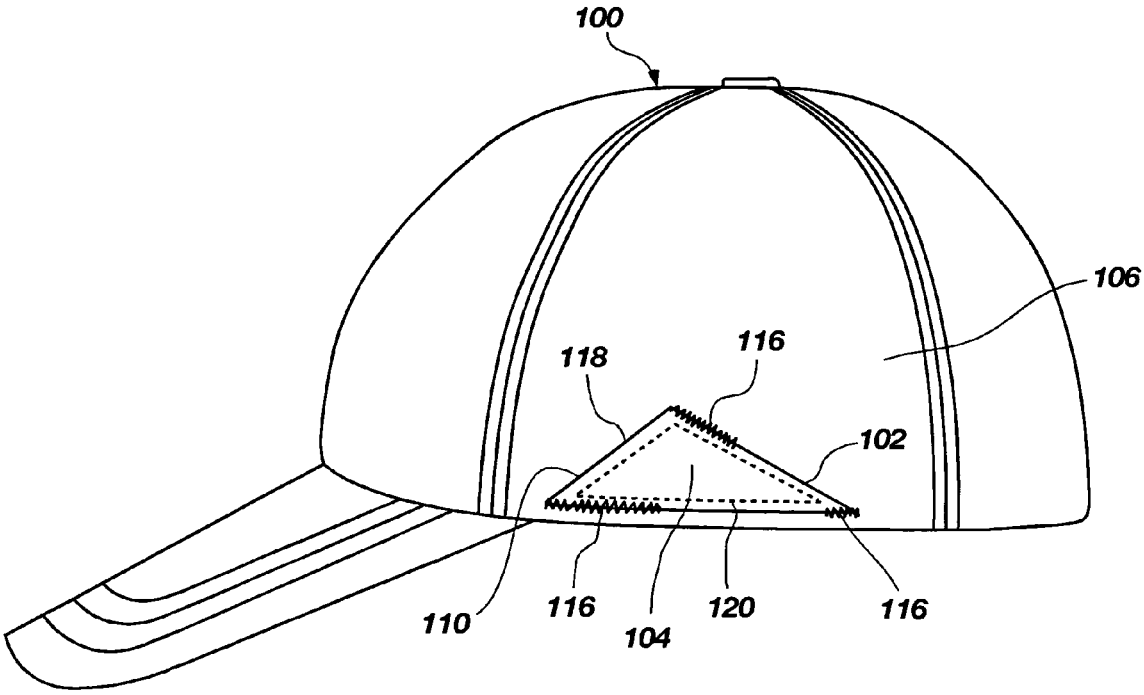
FIG. 33 is a side view of the externally mounted utility holder assembly embodiment of FIG. 32.

FIG. 33 depicts the holder 102 attached to the exterior surface 106 of the headwear 100. Zig-zag stitching 116 secures the cover 104 to the exterior surface 106 of the headwear 100. The placement of the stitching 116 forms a front entrance 118 to the area defined between the holder 102 and the exterior surface 106 of the headwear 100. Dashed-lines 120 represent the positioning of the spring 114 under the cover 104. The spring 114 may be attached to the backside of cover 104 using adhesive, stitching or any other suitable manner. In an alternative embodiment, the spring 114 may be inside of the cover 104.

It will be observed in FIG. 33, that the spring 114 is offset from the entrance 118 into the holder 102, and in particular, the front edge 110 of the cover 104. This spacing allows the entrance 118 to be wider than if the spring 114 extended to the entrance 118. The wider entrance 118 is beneficial to allow a user to more easily insert articles into the holder 102.

Figure 34:
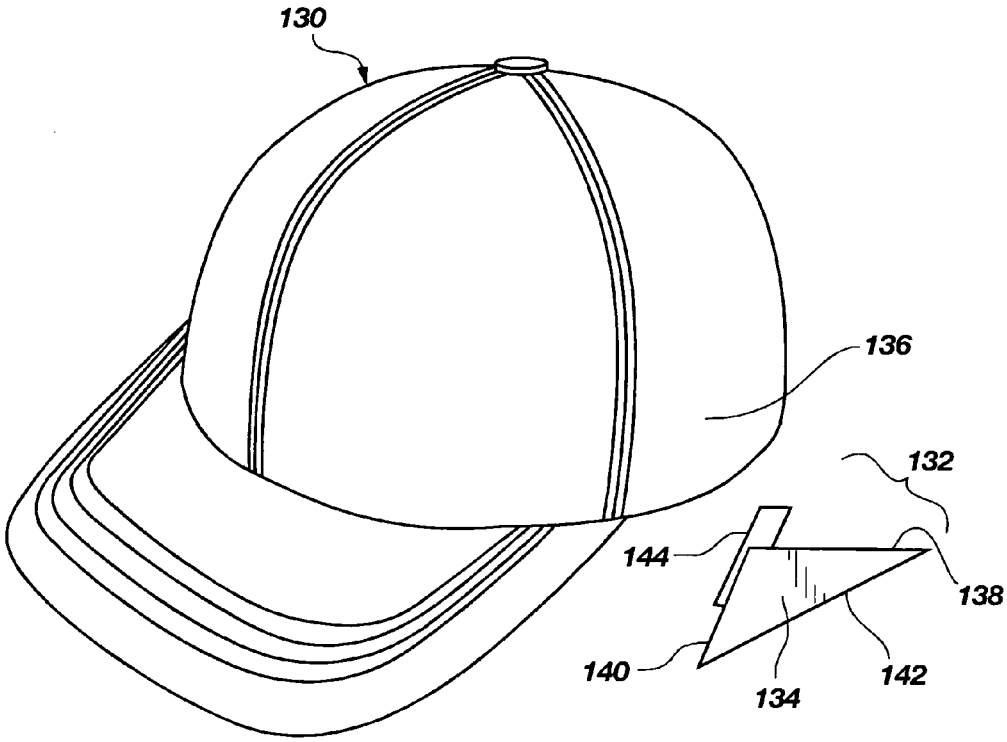
FIG. 34 is a perspective, three-dimensional exploded view of one embodiment of an externally mounted utility holder with a spring.

Referring now to FIG. 34, a perspective view of another illustrative embodiment of the present disclosure is shown, including a headwear member, indicated generally at 130. A holder, indicated by bracket 132 as shown in an exploded view in FIG. 34, may be disposed on one or more sides of the headwear member 130 for receiving an article, such as sunglasses. For example, a second holder may be positioned on an opposite side of the headwear 130 so that opposing temples of the sunglasses may each be received in a holder 132.

In the embodiment of FIG. 34, the holder 132 may be formed by attaching a cover 134 on an exterior surface 136 of the headwear 130. The cover 134 may be configured as a strip formed of any of various different types of materials. For example, the cover 134 may be formed of a material similar to that of the hat, such as a fabric, or elastic material, leather or any other suitable material known to those skilled in the art. One illustrative embodiment of the cover 134 may be formed as a substantially flat, flexible, polygonal member, such as a triangle, including a rear edge 138, a front edge 140, and a lower edge 142.

Still referring to FIG. 34, the front edge 140 may define an entrance to the holder 132 and may be configured to face a front of the headwear 130. The rear edge 138 may be opposite the front edge 140 and may be configured to face a rear of the headwear 130. The cover 134 may be configured to define the holder 132 with a portion of the exterior surface 136 of the headwear 130 to slideably receive a rearmost portion of an article to be stored securely on the headwear 130. It will be understood that other embodiments of the present disclosure may include covers of different shapes and sizes, and that other embodiments may also be oriented in different configurations on the headwear 130, such that the entrance of the holder 132 may extend in different directions in alternative embodiments. The cover 134 may be attached to the exterior surface 136 of the headwear 130 using stitches or adhesives or any other suitable attaching mechanism known in the art.

In the illustrative embodiment of FIG. 34, a spring 144 may be disposed on an interior surface of the holder 132 for preventing deformation of the cover 134. The spring 144 may be formed from a suitable resilient material such as plastic or metal. The shape of the spring 144 may be in the form of an elongated strip. The spring 144 prevents the release of articles held in the holder 132, especially when the headwear 130 has been removed from a user's head. The spring 144 maintains the shape of the holder 132 which would otherwise collapse or fold when the headwear 130 has been removed from a user's head. The collapsing or folding of the holder 132 would occur when the cover 134 is formed from a pliable material such as cloth. Thus, this embodiment provides an advantage over the previously known devices due to the fact that often times a user will forget that an article has been placed in holder 132.

Still referring to FIG. 34, when the user removes the headwear 130 from a head, the use of spring 144 resists the deformation or collapse of the holder 132 to thereby maintain the article securely attached to the headwear 130. In particular, the spring 144 prevents or resists the front edge 140 and rear edge 138 from collapsing onto bottom edge 142, especially when the headwear 130 has been removed from a user's head. The resilient nature of spring 144 ensures that the holder 132 will return to its normal position even in the event that the holder 132 is deformed for some reason. Thus, the spring 144 in this embodiment should have little or no positional memory when deformed. Further, by preventing deformation of the holder 132, the holder 132 stays in close proximity to the exterior surface 136 of the headwear. This close proximity allows any article disposed in the holder 132 to be held in place by the action of spring 144.

It will be appreciated that without the use of spring 144 shown in FIG. 34, the cover 134 may sag or otherwise separate away from the exterior surface 136 of the headwear 130, especially when the headwear 130 has been removed from a user's head. This sagging or separation may allow any article held in the holder 132 to fall to the ground and be damaged.

Figure 35:
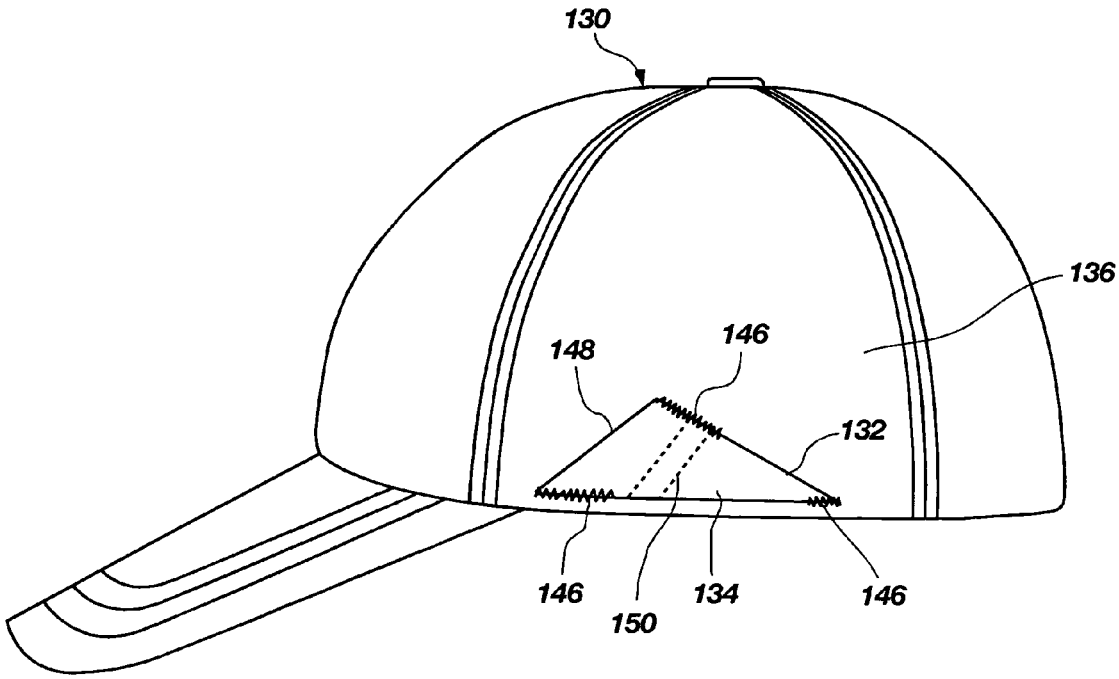
FIG. 35 is a side view of the externally mounted utility holder assembly embodiment of FIG. 34.

FIG. 35 depicts the holder 132 attached to the exterior surface 136 of the headwear 130. Zig-zag stitching 146 secures the cover 134 to the exterior surface 136 of the headwear 130. The placement of the stitching 146 forms a front entrance 148 to the area defined between the holder 132 and the exterior surface 136 of the headwear 130. Dashed-lines 150 represent the positioning of the spring 144 under the cover 134. The spring 144 may be attached to the backside of cover 134 using adhesive, stitching or any other suitable manner. In an alternative embodiment, the spring 144 may be mounted inside of the cover 134.

It will be observed in FIG. 35, that the spring 144 is offset from the entrance 148 into the holder 132. This spacing allows the entrance 148 to be wider than if the spring 144 extended to the entrance 148. The wider entrance 148 is beneficial to allow a user to more easily insert articles into the holder 132.

Figure 36:
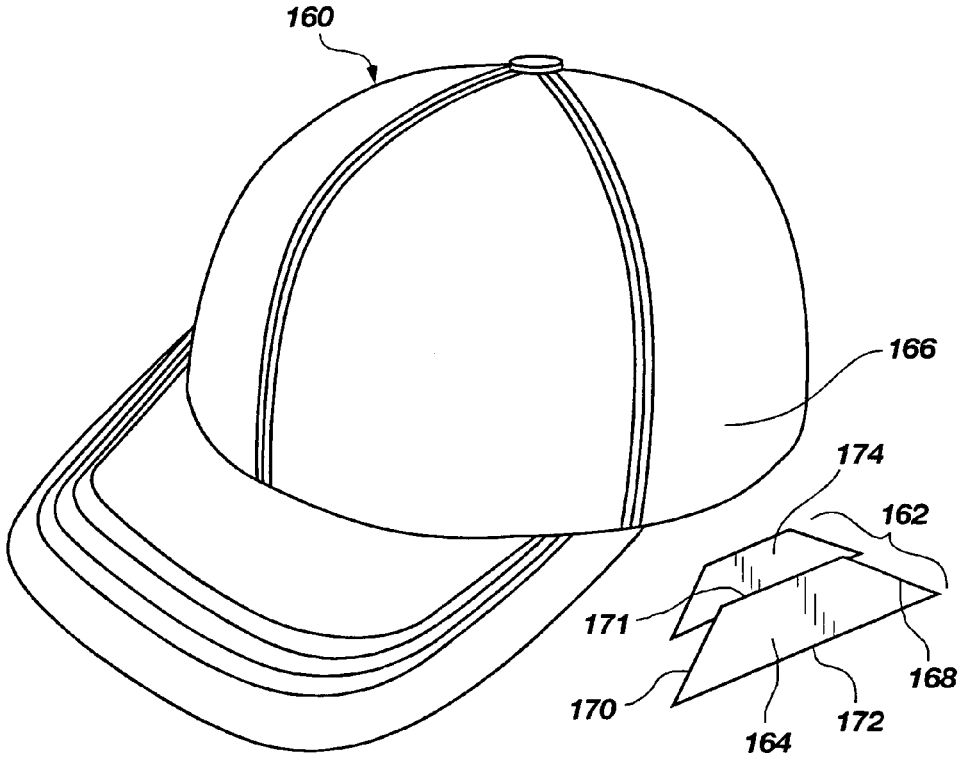
FIG. 36 is a perspective, three-dimensional exploded view of one embodiment of an externally mounted utility holder with a spring.

Referring now to FIG. 36, a perspective view of another illustrative embodiment of the present disclosure is shown, including a headwear member, indicated generally at 160. A holder, indicated by bracket 162 as shown in an exploded view in FIG. 36, may be disposed on one or more sides of the headwear member 160 for receiving an article, such as sunglasses. For example, a second holder may be positioned on an opposite side of the headwear 160 so that opposing temples of the sunglasses may each be received in a holder 162.

In the embodiment of FIG. 36, the holder 162 may be formed by attaching a cover 164 on an exterior surface 166 of the headwear 160. The cover 164 may be configured as a strip formed of any of various different types of materials. For example, the cover 164 may be formed of a material similar to that of the hat, such as a fabric, or elastic material, leather or any other suitable material known to those skilled in the art. One illustrative embodiment of the cover 164 may be formed as a substantially flat, flexible, polygonal member, such as a trapezoid, including a rear edge 168, a front edge 170, a top edge 171 and a lower edge 172.

Still referring to FIG. 36, the front edge 170 may define an entrance to the holder 162 and may be configured to face a front of the headwear 160. The rear edge 168 may be opposite the front edge 170 and may be configured to face a rear of the headwear 160. The cover 164 may be configured to define the holder 162 with a portion of the exterior surface 166 of the headwear 160 to slideably receive a rearmost portion of an article to be stored securely on the headwear 160. It will be understood that other embodiments of the present disclosure may include covers of different shapes and sizes, and that other embodiments may also be oriented in different configurations on the headwear 160, such that the entrance of the holder 162 may extend in different directions in alternative embodiments. The cover 164 may be attached to the exterior surface 166 of the headwear 160 using stitches or adhesives or any other suitable attaching mechanism known in the art.

In the illustrative embodiment of FIG. 36, a spring 174 may be disposed on an interior surface of the holder 162 for preventing deformation of the cover 164. Alternatively, the spring 174 may be disposed inside of the cover 164. The spring 174 may be formed from a suitable resilient material such as plastic or metal. The shape of the spring 174 may be in the form of a trapezoid. The spring 174 prevents the release of articles held in the holder 162, especially when the headwear 160 has been removed from a user's head. The spring 174 maintains the shape of the holder 162 which would otherwise collapse or folds when the headwear 160 has been removed from a user's head. The collapsing or folding of the holder 162 would occur when the cover 164 is formed from a pliable material such as cloth. Thus, this embodiment is an advantage over the prior art due to the fact that often times a user will forget that an article has been placed in holder 162. When the user removes the headwear 160, the use of spring 174 resists the deformation or collapse of the holder 162 to thereby maintain the article securely attached to the headwear 160. In particular, the spring 174 prevents or resists the front edge 170, top edge 171 and rear edge 168 from collapsing onto bottom edge 172, especially when the headwear 160 has been removed from a user's head. The resilient nature of spring 174 ensures that the holder 162 will return to its normal position even in the event that the holder 162 is deformed for some reason. Thus, the spring 174 should have little or no memory when deformed. Further, by preventing deformation of the holder 162, the holder 162 stays in close proximity to the exterior surface 166 of the headwear 160. This close proximity allows any article disposed in the holder 162 to be held in place by the action of spring 174. It will be appreciated that without the use of spring 174, the cover 164 may sag or otherwise separate away from the exterior surface 166 of the headwear 160, especially when the headwear 160 has been removed from a user's head. This sagging or separation may allow any article held in the holder 162 to fall to the ground and be damaged.

Figure 37:
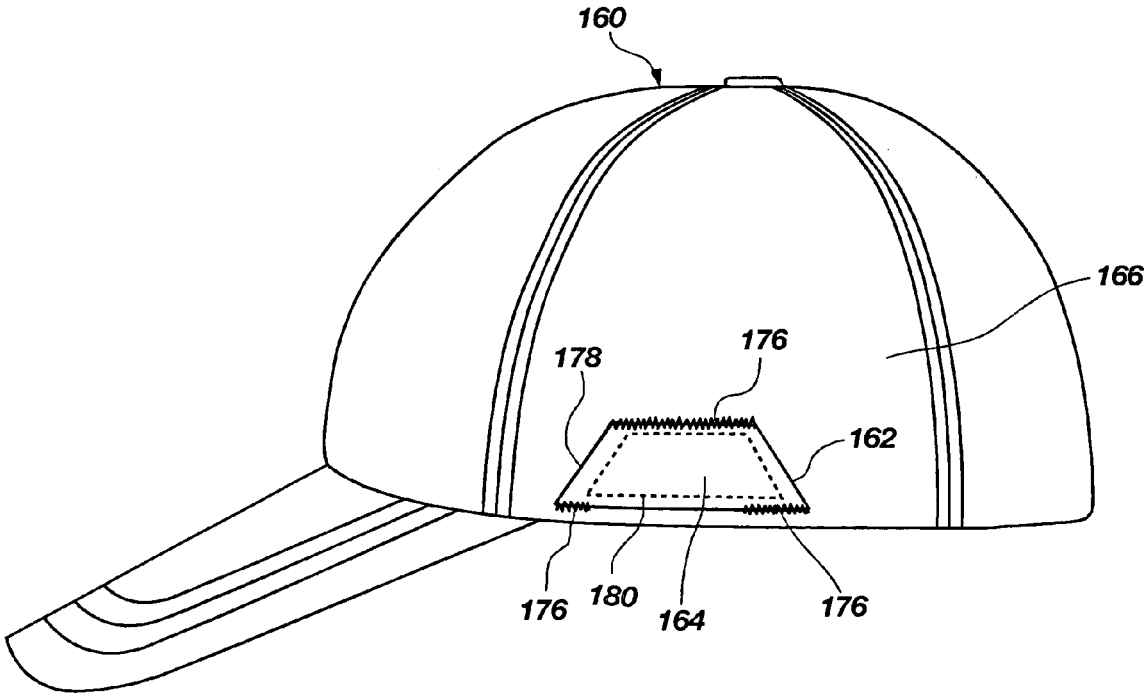
FIG. 37 is a side view of the externally mounted utility holder assembly embodiment of FIG. 36.

FIG. 37 depicts the holder 162 attached to the exterior surface 166 of the headwear 160. Zig-zag stitching 176 secures the cover 164 to the exterior surface 166 of the headwear 160. The placement of the stitching 176 forms a front entrance 178 to the area defined between the holder 162 and the exterior surface 166 of the headwear 160. Dashed-lines 180 represent the positioning of the spring 174 under the cover 164. The spring 174 may be attached to the backside of cover 164 using adhesive, stitching or any other suitable manner.

It will be observed in FIG. 37, that the spring 174 is offset from the entrance 178 into the holder 162. This spacing allows the entrance 178 to be wider than if the spring 174 extended to the entrance 178. The wider entrance 178 is beneficial to allow a user to more easily insert articles into the holder 162.

Figure 38:
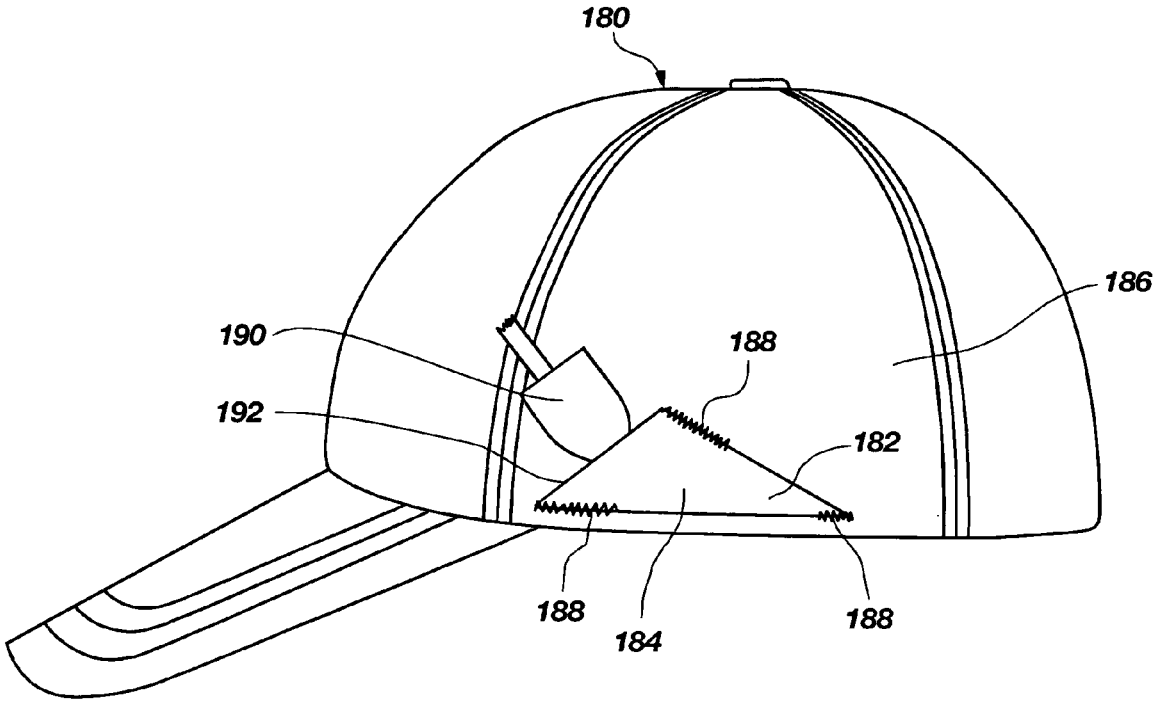
FIG. 38 is a side view of an externally mounted utility holder assembly with a spacer device.

Referring now to FIG. 38, which is a side view of another illustrative embodiment of the present disclosure is shown, including a headwear member, indicated generally at 180. A holder 182 may be disposed on one or more sides of the headwear member 180 for receiving an article, such as sunglasses. For example, a second holder may be positioned on an opposite side of the headwear 180 so that opposing temples of the sunglasses may each be received in a holder 182. In the embodiment of FIG. 32, the holder 182 may be formed by attaching a cover 184 on an exterior surface 186 of the headwear 186. Zig-zag stitching 188 may be used to attach the cover 184 to the exterior surface 186 of the headwear 180. A spacing device 190 may be inserted into an entrance 192 of the holder 182 while the cover 184 is sewn to the headwear 180. In this manner, it can be assured that the entrance 192 is wide enough to accept the desired articles.

In accordance with the features and combinations described above, a useful method of making a headwear member with a holder includes the steps of:

(a) stitching a cover to an exterior surface of the headwear member along a front portion of a bottom edge of the cover;

(b) stretching the cover flat and stitching a rear portion of the bottom edge of the cover to the exterior surface of the headwear member;

(c) inserting a spacer into a front entrance of the holder; and (d) wrapping a front edge of the cover tightly across the spacer and then stitching a top portion of the cover to the exterior surface of the headwear member.

Those having ordinary skill in the relevant art will appreciate the advantages provide by the features of the present disclosure. For example, it is a feature of the present disclosure to provide an apparatus for holding an article to headwear which is simple in design and manufacture. Another feature of the present disclosure is to provide such an apparatus which is versatile for use with various different types of articles and various different types of headwear. It is a further feature of the present disclosure, in accordance with one aspect thereof, to provide an apparatus which is capable of enhanced gripping of the article to more securely hold the article to the headwear. It is an additional feature of the present disclosure to provide an apparatus for holding an article to headwear which has an aesthetically pleasing appearance. Those skilled in the pertinent arts will particularly appreciate the advantages which accrue with the provision of the enhanced gripping of the articles discussed in the present disclosure.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. An apparatus for securing an article to a user's head, said apparatus comprising:

a headwear member for attaching to said user's head, said headwear member comprising an exterior surface;

a cover disposed on said headwear member, said cover comprising an interior surface and defining a holder with a portion of said exterior surface of said headwear member for receiving said article therein, said cover further comprising an upper edge, a lower edge, a front edge defining an entrance to said holder configured to face a front of said headwear member, and a rear edge opposite said front edge configured to face a rear of said headwear member, the lower edge fixedly attached to a larger portion of the headwear member than the front edge and the rear edge; and gripping means disposed on said holder for gripping said article.

2. The apparatus of claim 1, wherein said upper edge and said lower edge are joined with said headwear portion such that access within said holder is prevented through said upper edge and said lower edge.

3. The apparatus of claim 1, wherein said gripping means comprises hook and loop fasteners.

4. The apparatus of claim 1, wherein said gripping means comprises a ductile sheet member.

5. The apparatus of claim 1, wherein said gripping means comprises a ductile member disposed on said front edge of said cover, said ductile member being configured to allow said article to be received in said holder and for deft), wing to assist in holding said article within said holder.

6. The apparatus of claim 5, wherein said ductile member extends along at least a portion of said upper edge and said lower edge.

7. The apparatus of claim 6, wherein said ductile member comprises a metal wire.

8. The apparatus of claim 1, wherein said holder comprises a plurality of pockets.

9. The apparatus of claim 1, wherein said front edge is disposed at an angle within a range of between approximately 30 to approximately 75 degrees with respect to said lower edge.

10. The apparatus of claim 9, wherein said front edge is disposed at an angle of approximately 60 degrees with respect to said lower edge.

11. The apparatus of claim 1, wherein said holder is configured to receive an article comprising of one of a group consisting of eyewear, tools, and writing utensils.

12. The apparatus of claim 1, wherein said holder has a length in a range of between 1.5 and 3 times a height of said holder.

13. The apparatus of claim 12, wherein said length is approximately 2 times said height.

14. The apparatus of claim 1, wherein said upper edge and said lower edge are joined with said headwear portion such that access within said holder is prevented through said upper edge and said lower edge;

wherein said front edge is disposed at an angle within a range of between approximately 45 to approximately 75 degrees with respect to said lower edge;

wherein said holder is configured to receive an article comprising of one of a group consisting of eyewear, tools, and writing utensils;

wherein said holder has a length in a range of between 1.25 and 4 times a height of said holder;

wherein said gripping means is disposed on said exterior surface of said headwear member and said interior surface of said cover; and wherein said apparatus further comprises a second holder on an opposite side of said headwear member.

15. The apparatus of claim 1, wherein said gripping means comprises foam rubber.

16. An apparatus for securing an article to a user's head, said apparatus comprising:

a headwear member for attaching to said user's head;

a holder disposed on said headwear member for receiving said article therein, said holder comprising an entrance to said holder; and a ductile member disposed adjacent said entrance of said holder, said ductile member being configured to allow said article to be received in said holder and for deforming to conform to a shape of said article upon application of pressure to the holder by a user and retaining said shape upon release of the pressure to assist in holding said article within said holder, wherein said entrance of said holder is disposed at an angle within a range of between approximately 45 to approximately 75 degrees with respect to a lower edge of said holder.

17. The apparatus of claim 16, wherein said holder comprises an upper edge, and wherein said ductile member extends along at least a portion of said entrance said upper edge and said lower edge.

18. The apparatus of claim 16, wherein said ductile member comprises a metal wire.

19. The apparatus of claim 16, wherein said holder comprises a cover disposed on an exterior surface of said headwear member.

20. The apparatus of claim 16, wherein said holder comprises a cover disposed on an interior surface of said headwear member.

21. The apparatus of claim 16, wherein said entrance is disposed at an angle of approximately 60 degrees with respect to said lower edge of said holder.

22. The apparatus of claim 16, wherein said holder is configured to receive an article comprising one of a group consisting of eyewear, tools, and writing utensils.

23. An apparatus for securing an article to a user's head, said apparatus comprising:

a headwear member for attaching to said user's head;

a holder disposed on said headwear member for receiving said article therein, said holder comprising an entrance to an interior surface of said holder, said holder further comprising a lower edge fixedly attached to a larger portion of the headwear member than adjacent edges;

wherein said entrance is disposed at an angle within a range of between approximately 45 to approximately 75 degrees with respect to said lower edge.

24. The apparatus of claim 23, wherein said entrance is disposed at an angle of approximately 60 degrees with respect to said lower edge of said holder.

25. The apparatus of claim 23, further comprising gripping means disposed on said interior surface of said holder for gripping said article.

26. The apparatus of claim 25, wherein said gripping means comprises hook and loop fasteners.

27. The apparatus of claim 25, wherein said gripping means comprises a ductile sheet member.

28. The apparatus of claim 25, wherein said gripping means comprises a ductile member disposed adjacent said entrance, said ductile member being configured to allow said article to be received in said holder and for deforming to assist in holding said article within said holder.

29. The apparatus of claim 28, wherein said ductile member extends along at least a portion of an upper edge of said holder and along at least a portion of said lower edge of said holder.

30. The apparatus of claim 29, wherein said ductile member comprises a metal wire.

31. The apparatus of claim 23, wherein said holder is configured to receive an article comprising of one of a group consisting of eyewear, tools, and writing utensils.

32. The apparatus of claim 23, further comprising at least one point stitch attaching said holder to said headwear member.

33. The apparatus of claim 23, wherein said holder comprises a substantial triangular shape.

34. The apparatus of claim 33, further comprising continuous stitching along at least a portion of said lower edge.

35. The apparatus of claim 23, wherein said holder comprises a substantial triangular shape having three corners, wherein said holder is attached to said headwear member with a point stitch at each of the corners and continuous stitching along at least a portion of said lower edge.

36. An apparatus for securing an article to a user's head, said apparatus comprising:

a headwear member for attaching to said user's head;

a holder disposed on said headwear member, said holder comprising an interior surface for receiving said article therein; and wherein said holder comprises a ductile sheet member, said ductile sheet member being configured to allow said article to be received in said holder and for deforming to conform to a shape of said article upon application of pressure to the holder by a user and retaining said shape upon release of the pressure to assist in holding said article within said holder, wherein said holder further comprises a cover having an upper edge, a lower edge, a front edge defining an entrance to said holder configured to face a front of said headwear member, and a rear edge opposite said front edge configured to face a rear of said headwear member.

37. The apparatus of claim 36, wherein said ductile sheet member is a metal foil.

38. The apparatus of claim 36, wherein said upper edge and said lower edge are joined with said headwear portion such that access within said holder is prevented through said upper edge and said lower edge.

39. The apparatus of claim 36, wherein said front edge is disposed at an angle within a range of between approximately 45 to approximately 75 degrees with respect to said lower edge.

40. The apparatus of claim 39, wherein said front edge is disposed at an angle of approximately 60 degrees with respect to said lower edge.

41. The apparatus of claim 36, wherein said holder is configured to receive an article comprising of one of a group consisting of eyewear, tools, and writing utensils.

42. The apparatus of claim 36, wherein said ductile sheet member is disposed on an exterior surface of said headwear member.

43. The apparatus of claim 36, wherein said ductile sheet member is disposed on an interior surface of said headwear member.

44. The apparatus of claim 36, wherein said ductile sheet member is disposed on an interior surface of said cover.

45. An apparatus for securing an article to a user's head, said apparatus comprising:

a headwear member for attaching to said user's head, said headwear member comprising an exterior surface and an interior surface;

a holder disposed on said headwear member for receiving said article therein, said holder comprising an entrance to said holder through said headwear member, said holder further comprising a cover disposed on said interior surface of said headwear member, said cover comprising a polygonal member having height between an upper edge and a lower edge of said cover, and a length between a front edge and a rear edge of said cover;

wherein said length is dimensioned in a range of between 1.5 and 3 times said height of said cover.

46. The apparatus of claim 45, wherein said length of said cover is approximately 2 times said height of said cover.

47. The apparatus of claim 45, further comprising gripping means disposed on said holder for gripping said article.

48. The apparatus of claim 47, wherein said gripping means comprises hook and loop fasteners.

49. The apparatus of claim 47, wherein said gripping means comprises a ductile sheet member.

50. The apparatus of claim 47, wherein said gripping means comprises a ductile member disposed adjacent said entrance.

51. The apparatus of claim 50, wherein said ductile member extends along at least a portion of said upper edge and said lower edge.

52. The apparatus of claim 51, wherein said ductile member comprises a metal wire.

53. The apparatus of claim 45, wherein said entrance is disposed at an angle within a range of between approximately 45 to approximately 75 degrees with respect to said lower edge.

54. The apparatus of claim 53, wherein said entrance is disposed at an angle of approximately 60 degrees with respect to said lower edge.

55. An apparatus for securing an article to a user's head, said apparatus comprising:

a headwear member for attaching to said user's head;

a holder disposed on said headwear member for receiving said article therein, said holder comprising an entrance to an interior surface of said holder, said holder further comprising a lower edge;

wherein said holder comprises a polygonal shape having a plurality of corners, wherein said plurality of corners are attached to said headwear member, wherein at least a portion of said lower edge is fixedly attached to a larger portion of said headwear member than adjacent edges and a remainder of said lower edge defines an opening to said interior surface of said holder.

56. The apparatus of claim 55, wherein said plurality of corners are attached to said headwear member with point stitches.

57. The apparatus of claim 55, wherein said holder comprises a substantial triangular shape.

58. The apparatus of claim 55, wherein said entrance is disposed at an angle within a range of between approximately 45 to approximately 75 degrees with respect to said lower edge.

59. The apparatus of claim 55, further comprising gripping means disposed on said interior surface of said holder for gripping said article.

60. The apparatus of claim 59, wherein said gripping means comprises hook and loop fasteners.

61. The apparatus of claim 59, wherein said gripping means comprises a ductile sheet member.

62. The apparatus of claim 59, wherein said gripping means comprises foam rubber.

63. The apparatus of claim 55, wherein said gripping means comprises a ductile member disposed adjacent said entrance, said ductile member being configured to allow said article to be received in said holder and for deforming to assist in holding said article within said holder.

64. An apparatus for securing an article to a user's head, said apparatus comprising:

a headwear member for attaching to said user's head, said headwear member comprising an exterior surface;

a cover disposed on said headwear member, said cover comprising an interior surface and defining a holder with a portion of said exterior surface of said headwear member for receiving said article therein; and a spring for minimizing deformation of the cover, wherein the spring is sewn or glued inside of said cover.

65. The apparatus of claim 64 wherein the spring is an elongated strip of resilient material.

66. The apparatus of claim 64 wherein the spring is enclosed or wrapped inside of said cover.

67. The apparatus of claim 64 wherein the spring is comprised of plastic.

68. The apparatus of claim 64 wherein the spring is comprised of metal.

69. The apparatus of claim 64 wherein the holder comprises an entrance, and wherein said spring is offset from said entrance to thereby allow a gap in said entrance.

70. The apparatus of claim 64 wherein the cover and the spring have substantially the same shape.

71. The apparatus of claim 64 where the cover has a substantially triangular shape.

72. An apparatus for securing an article to a user's head, said apparatus comprising:

a headwear member for attaching to said user's head;

a holder disposed on said headwear member for receiving at least a portion of said article therein, said holder comprising an entrance to an interior surface of said holder, said holder having shape; and a spring for securing said article in said holder when said headwear member is not attached to said user's head by minimizing deformation of the holder, wherein the spring is glued to said interior surface of said holder.

73. The apparatus of claim 72 wherein the spring is enclosed or wrapped within said holder.

74. The apparatus of claim 72 wherein the spring is formed from at least one of plastic and metal.

75. The apparatus of claim 72 wherein spring is offset from said entrance of the holder.

76. The apparatus of claim 72 wherein the shape of the holder is substantially triangular.

77. The apparatus of claim 72 where the shape of the holder is polygonal.

78. The apparatus of claim 72 wherein the spring comprises an elongated strip.

* * * * *

UNITED STATES PATENT AND TRADEMARK OFFICE

CERTIFICATE OF CORRECTION

PATENT NO. : 7,979,921 B2
APPLICATION NO. : 11/652971
DATED : July 19, 2011
INVENTOR(S) : Peter Cotutsca It is certified that error appears in the above-identified patent and that said Letters Patent is hereby corrected as shown below:

Column 19, Claim 5, line 2, please delete “deft), wing” and insert --deforming--.

Signed and Sealed this
Twentieth Day of September, 2011

David J. Kappos

David J. Kappos
*Director of the United States Patent and Trademark Office*